United States Patent [19]

Iwata

[11] Patent Number: 4,990,956

[45] Date of Patent: Feb. 5, 1991

[54] IMAGE FORMING APPARATUS

[75] Inventor: Yasuhiro Iwata, Yokohama, Japan

[73] Assignee: Kabushiki Kaisha Toshiba, Kawasaki, Japan

[21] Appl. No.: 333,200

[22] Filed: Apr. 5, 1989

[30] Foreign Application Priority Data

Apr. 7, 1988 [JP] Japan ..... 63-85961
Apr. 22, 1988 [JP] Japan ..... 63-99522

[51] Int. Cl.[5] ..... G03G 21/00
[52] U.S. Cl. ..... 355/218; 355/230
[58] Field of Search ..... 355/218, 230, 231, 234, 355/208, 209, 210, 204

[56] References Cited

U.S. PATENT DOCUMENTS 4,692,019 9/1987 Morimoto et al. ..... 355/218 X
4,713,550 12/1987 Anzai et al. ..... 355/204 X
4,745,438 5/1988 Acquaviva et al. ..... 355/218 X

*Primary Examiner*—A. T. Grimley
*Assistant Examiner*—Sandra L. Hoffman
*Attorney, Agent, or Firm*—Foley & Lardner, Schwartz, Jeffery, Schwaab, Mack, Blumenthal & Evans

[57] ABSTRACT

An image forming apparatus comprises a main charger for charging the surface of a photosensitive drum, an exposure unit for illuminating an original and guiding light from the original onto the drum, thereby forming thereon an electrostatic latent image corresponding to an image of the original, a detector for detecting the size of the original, and an erase array for erasing an undesired electric charge on the photosensitive drum in accordance with the original size detected by the detector.

27 Claims, 26 Drawing Sheets

DETECTING POSITION

| ORIGINAL SIZE \ DETECTOR | T | | U | | V | | W | | X | | Y | | Z | |
|---|---|---|---|---|---|---|---|---|---|---|---|---|---|---|
| | 63a | 63b | 63a | 63b | 63a | 63b | 63a | 63b | 63a | 63b | 63a | 63b | 63a | 63b |
| A3 | ○ | ○ | ○ | ○ | ○ | ○ | ○ | ○ | ○ | ○ | ○ | ○ | ○ | ○ |
| B4 | ○ | ○ | ○ | ○ | ○ | ○ | ○ | ○ | ○ | ○ | ○ | ○ | × | × |
| A4-HORIZONTAL | × | ○ | × | ○ | × | ○ | × | ○ | × | ○ | × | × | × | × |
| B5-HORIZONTAL | × | ○ | × | ○ | × | ○ | × | ○ | × | × | × | × | × | × |
| A4-VERTICAL | ○ | ○ | ○ | ○ | ○ | ○ | × | × | × | × | × | × | × | × |
| B5-VERTICAL | ○ | ○ | ○ | ○ | × | × | × | × | × | × | × | × | × | × |
| A5-HORIZONTAL | × | ○ | × | ○ | × | ○ | × | × | × | × | × | × | × | × |
| A5-VERTICAL | × | ○ | × | × | × | × | × | × | × | × | × | × | × | × |

FIG. 10

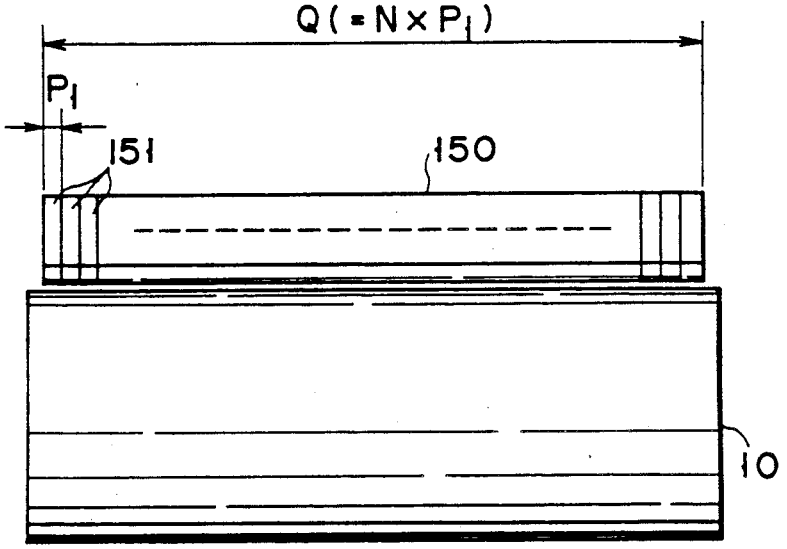
FIG. 16
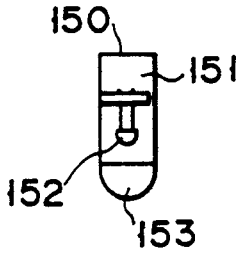
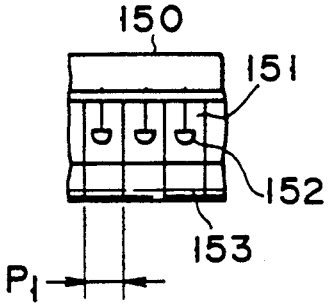
FIG. 17A FIG. 17B

IMAGE FORMING APPARATUS

BACKGROUND OF THE INVENTION

1. Field of the Invention

The present invention relates to an image forming apparatus such as an electronic copying machine.

2. Description of the Related Art

In an electronic copying machine using an electrophotographic process, for example, an original set on an original table is concealed under an original cover. The original and the cover are illuminated by means of an exposure lamp. Light beams reflected by the original and the cover are guided onto a photosensitive drum. As a result, an electrostatic latent image corresponding to an image of the original is formed on the surface of the previously charged drum, and any undesired electric charge around the latent image is removed.

If the original is scanned uncovered, for example, light beams applied to regions outside the original cannot be reflected by the original cover, so that they cannot be led to the photosensitive drum. Thus, the undesired charge around the electrostatic latent image corresponding to the original image cannot be removed, so that a toner adheres also to the peripheral regions outside the latent image, during a developing process. Therefore, if the original is smaller in size than a copying sheet, or if the size of the formed image is smaller than the sheet size although the original and the sheet are equal in size, as in the case of reduced-scale copy, the peripheral region of an output image (copy image) around the region corresponding to the original image is blackened by the toner. When copying a thick original such as a book, moreover, the original cover cannot be fully in contact with the original table, so that an undesired black image develops on the peripheral region of the output image.

If the undesired black image (black solid image) develops in this manner, the output image is unpleasant in appearance and poor in quality. Further, a waste of the toner entails an increase of the consumption of a developing agent.

SUMMARY OF THE INVENTION

The object of the present invention is to provide an image forming apparatus in which an undesired black image can be prevented from developing around that region of an output image which corresponds to an original image, so that the original image has an improved quality, and a developing agent can be prevented from being wastefully consumed.

According to an aspect of the present invention, there is provided an image forming apparatus, which comprises image forming means for forming on an image carrier a first copy image corresponding to an image of an original and a second copy image corresponding to an image of a region surrounding the original image; size detecting means for detecting the size of the original; and preventing means for preventing the formation of the second copy image in accordance with the result of detection by the size detecting means.

BRIEF DESCRIPTION OF THE DRAWINGS

FIG. 10 is a logic diagram showing discrimination data used for the original size detection by the apparatus shown in FIG. 1;

FIG. 16 is a front view showing the relative positions of the erase array and the photosensitive drum of the apparatus shown in FIG. 1;

FIG. 17A is a side sectional view of the erase array shown in FIG. 14;

FIG. 17B is a front view of the erase array shown in FIG. 14;

DETAILED DESCRIPTION OF THE PREFERRED EMBODIMENTS

A first embodiment of the present invention will now be described with reference to the accompanying drawings of FIGS. 1 to 22.

Figure 1:
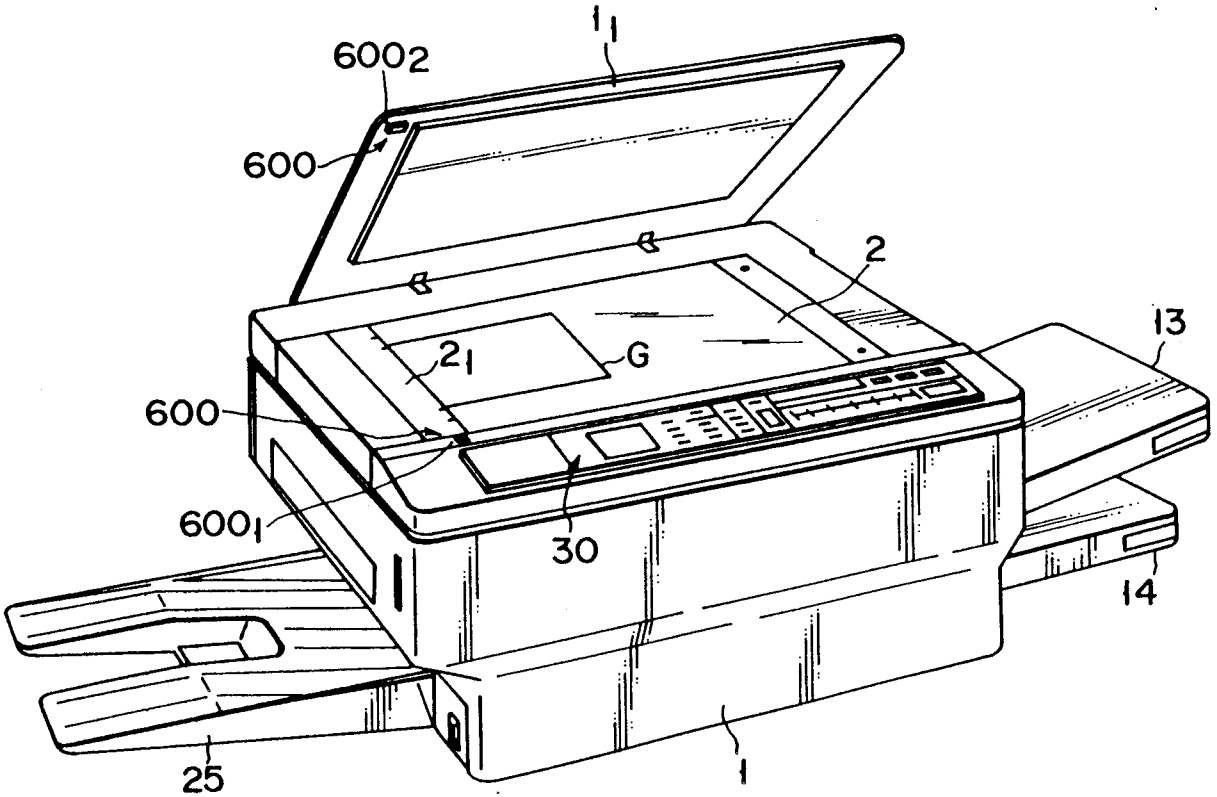
FIG. 1 is a perspective view showing a first embodiment of a copying machine as an image forming apparatus according to the present invention.

FIG. 1 schematically shows a copying machine as an image forming apparatus according to the present invention. In FIG. 1, numeral 1 designates a housing of the copying machine. Original table (transparent glass) 2 for supporting original G is provided on the top of housing 1. Also provided on the top of housing 1 is fixed scale $2_1$ which, adjoining one end edge of table 2, serves as a reference for setting original G. Swingable original cover $1_1$ is pivotally mounted on the rear side of the top of housing 1, with respect to original table 2. It is used to cover the original set on table 2. Moreover, magnet $600_1$ is mounted on the top of housing 1 near the front left side of table 2. Reed switch $600_2$ is attached to cover $1_1$, corresponding to magnet $600_1$. Magnet $600_1$ and switch $600_2$ constitute cover detecting switch 600 which detects the state or position of original cover $1_1$. Control panel 30 is provided on the front side of the top of housing 1. Upper and lower sheet cassettes 13 and 14 for automatic sheet feed are attached to the right-hand side of housing 1. Receiving tray 25 for receiving copies discharged from housing 1 is attached to the left-hand side of the housing.

Figure 2:
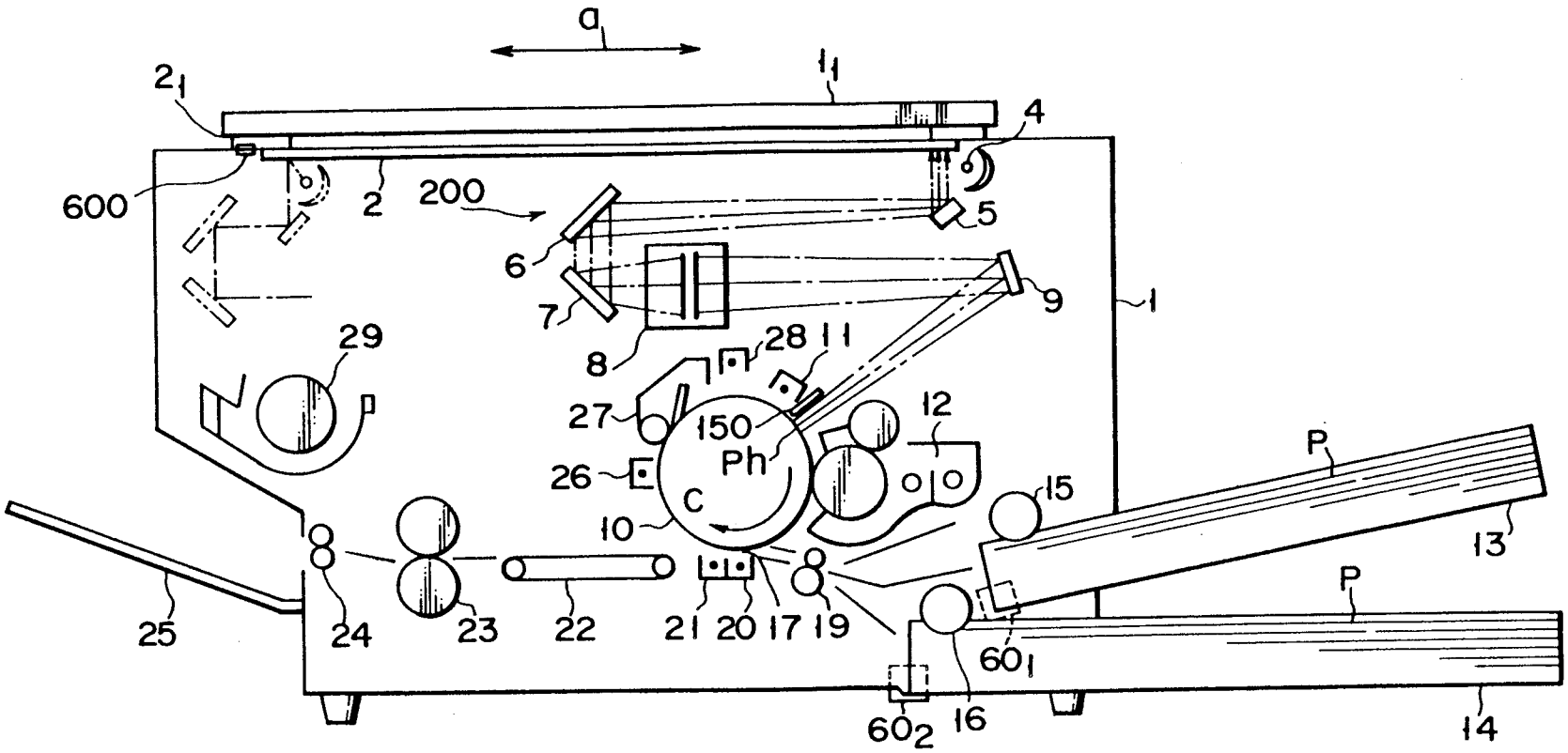
FIG. 2 is a schematic view showing the internal construction of the apparatus shown in FIG. 1.

As shown in FIG. 2, photosensitive drum 10 is rotatably supported substantially in the center of the inside space of housing 1. It is adapted to be rotated in the direction of arrow c of FIG. 2 with the progress of copying operation. Disposed between drum 10 and original table 2 is exposure unit 200, which illuminates the original on table 2, and guides a light reflected by the original onto the drum, thereby forming an image thereon. Developing device 12, transfer charger 20, separation charger 21, de-electrification charger 26, cleaner 27, discharge lamp 28, and main charger 11 are arranged successively in the rotating direction of photosensitive drum 10, starting from image forming position Ph of exposure unit 200.

Exposure unit 200 includes lamp 4, first, second, third, and fourth mirrors 5, 6, 7 and 9, and lens block 8. Lamp 4 is used to expose the original on original table 2. The four mirrors guide the reflected light from the original to exposure region Ph on photosensitive drum 10. Lens block 8 serves to project the light guided by the mirrors onto drum 10. As lamp 4 and first to third mirrors 5 to 7 are reciprocated in the direction of arrow a along the lower surface of original table 2, the original on table 2 is exposed and scanned. In this case, second and third mirrors 6 and 7 are moved at half the moving speed of lamp 4 and first mirror 5 so that the length of an optical path from the surface of the original to drum 10 is kept fixed.

Photosensitive drum 10 is rotated in the direction of arrow c of FIG. 2, and the surface of the drum is charged by main charger 11. Thereafter, the light reflected by the original is guided to exposure region Ph on drum 10 so that the drum is slit-exposed. Thus, an electrostatic latent image is formed on the surface of photosensitive drum 10. A toner is caused to adhere to the latent image by means of developing device 12. As a result, the latent image is visualized, so that a toner image is formed. This toner image is transferred to the surface of paper sheet P by means of transfer charger 20. At this point of time, sheet P is caused electrostatically to adhere to the surface of drum 10. Then, the sheet is separated from drum 10 by means of separation charger 21. Toner particles remaining on drum 10 without having been transferred to the drum surface, after the transfer process, are de-electrified by means of de-electrification charger 26. Then, the residual toner particles on drum 10 are removed by means of cleaner 27. Thereafter, a residual image on photosensitive drum 10 is erased by means of discharge lamp 28, so that the drum is restored to its initial state.

Paper-supply rollers 15 and 16 are arranged at the bottom portion of the inside space of housing 1. These rollers are used to feed sheets one by one from upper and lower sheet cassettes 13 and 15. The selection between the upper and lower cassettes is effected by means of control panel 30 mentioned later. The sizes of sheet cassettes 13 and 14 are detected T by means of cassette size detecting switches $60_1$ and $60_2$, respectively. These detecting switches are each formed of a plurality of microswitches which are turned on and off when cassettes 13 and 14 of different sizes are inserted.

A pair of aligning rollers 19 are disposed between transfer charger 20 and paper-supply rollers 15 and 16. Rollers 19 serve to align sheet P transported thereto by means of rollers 15 and 16 and thereafter deliver the sheet to transfer region 17 between photosensitive drum 10 and transfer charger 20.

Disposed between separation charger 21 and receiving tray 25 are conveyor belt 22, a pair of fixing rollers 23, and a pair of exit rollers 24. Belt 22 is used to transport sheet P separated by means of separation charger 21. Fixing rollers 23 are used to fix the toner image on the sheet transport by means of the conveyor belt. Exit rollers 24 are used to discharge sheet P onto tray 25 after the fixing process. Disposed inside housing 1, moreover, is cooling fan 29 for preventing the temperature inside the housing from increasing.

Figure 3:
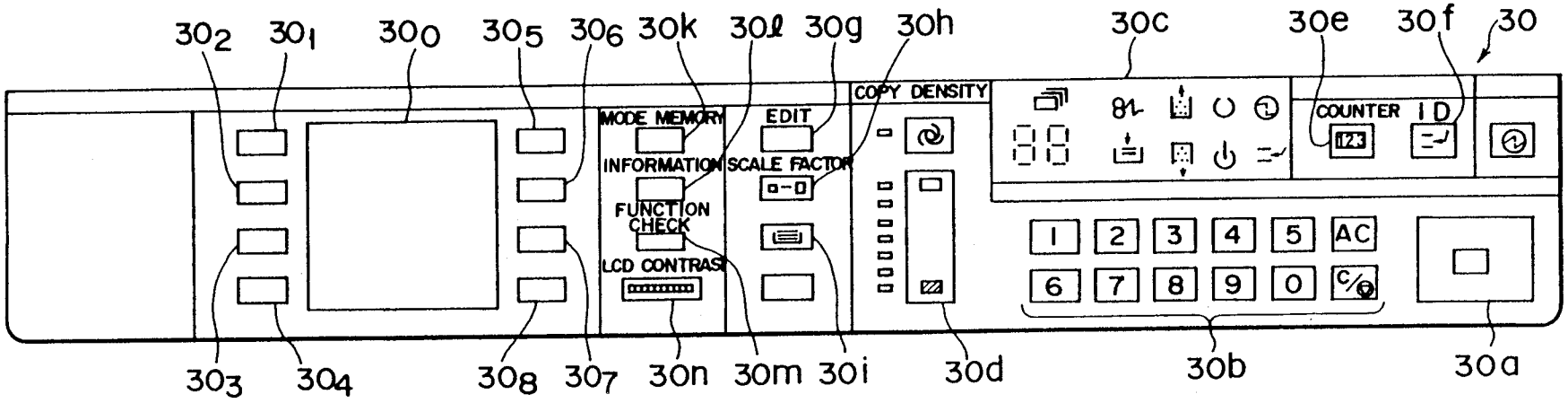
FIG. 3 is a plan view of a control panel of the apparatus shown in FIG. 1.

FIG. 3 shows control panel 30. Numeral 30*a* designates a copy key; 30*b*, a ten-key pad; 30*c*, a display unit; 30*d*, a density setting unit; 30*e*, a count command key; and 30*f*, an ID count key. When copy key 30*a* is operated, an instruction for the start of copying is given.

Ten-key pad 30b is used to set the number of copies and the like. Display unit 30c serves to indicate the operating states of various parts, jamming of the sheets, etc. Setting unit 30d is used to set the copy density. The total number of copies is indicated when command key 30e is operated. Count key 30f is used to indicate a copy number corresponding to each ID code when an ID copy mode is established such that copying is allowed only when the ID code is identified.

Further, numeral 30g designates an edit key; 30h, a scale factor setting key; 30i, a cassette select key; 30k, a mode memory key; and 301, an information key. Edit key 30g is operated in starting multi-copying. Setting key 30h is used to set the copy scale factor. Select key 30i is used to make a selection between upper and lower sheet cassettes 13 and 14. When edit key 30g is operated and copying conditions and the like are set in this state, for example, memory key 30k can be used to store the set copying conditions or read out previously stored copying conditions and other information. Information key 301 is operated to obtain information corresponding to each mode. If key 301 is operated in case of sheet jamming, for example, information for removing the jam is indicated on display unit 30o mentioned later.

Numeral 30m designates a function check key. When key 30m is operated, set functions are indicated on display unit 30o. Numeral 30n designates a dial for adjusting the contrast of unit 30o. Display unit 30o is formed of a liquid-crystal dot matrix panel, for example. The set conditions of the copying machine and other information are indicated in characters or the like on unit 30o. When keys 30e, 30f and 30g to 30m are operated, characters corresponding to these keys are displayed. Operation keys $30_1$ to $30_4$ and $30_5$ to $30_8$, used to select various functions to be indicated on display unit 30o, are arranged on either side of unit 30o.

Figure 4:
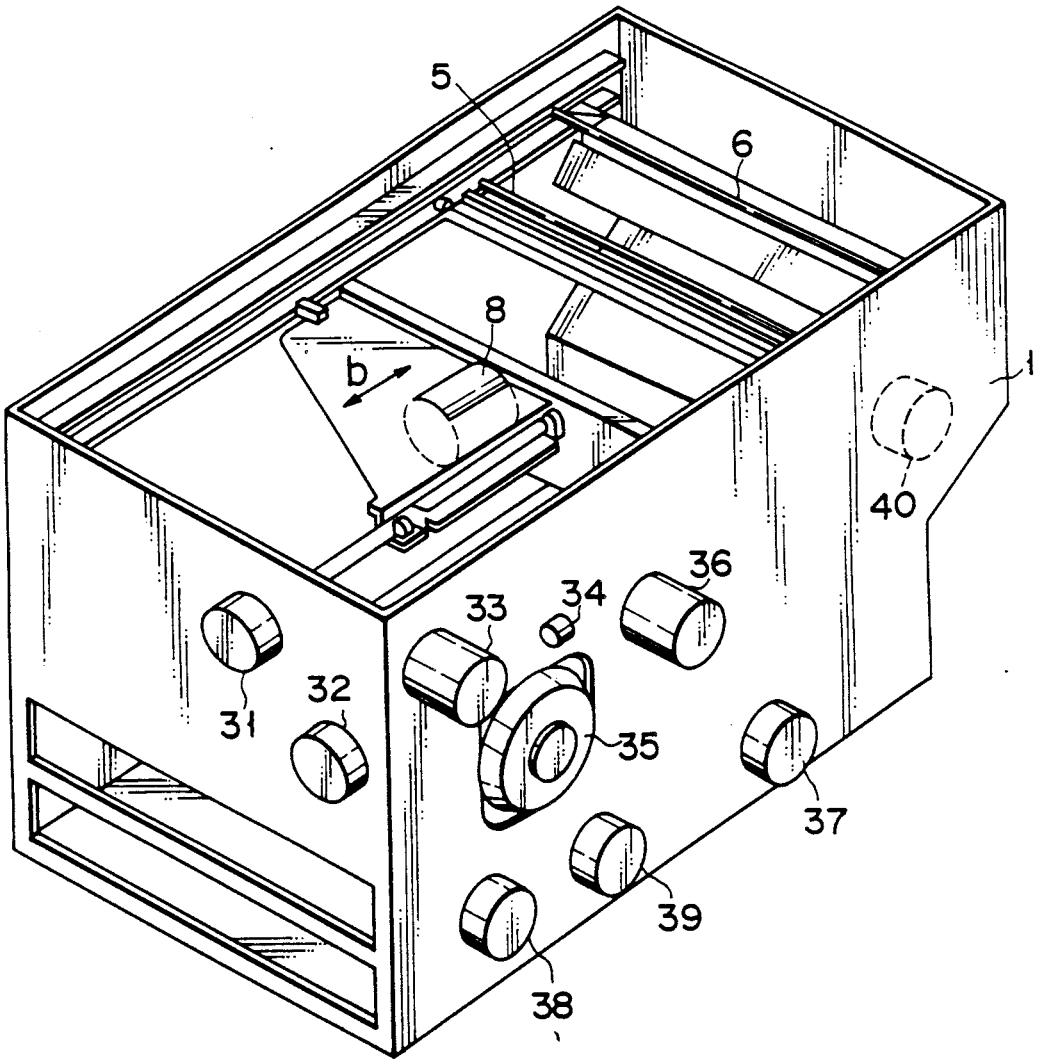
FIG. 4 is a perspective view showing drive units of the apparatus shown in FIG. 1.

FIG. 4 shows a drive source for various drive units of the copying machine. Numeral 31 designates a lens motor; 32, a mirror motor; 33, a scanning motor; 34, a shutter motor; 35, a developing motor; 36, drum motor; 37, a fixing motor; 38, a paper supply motor; 39, a sheet feed motor; and 40, a fan motor. Lens motor 31 is used to shift the position of lens block 8 in the direction of arrow b, in order to change the scale factor. Mirror motor 32 is used to change the distance (optical path length) from first mirror 5 to second and third mirrors 6 and 7, for scale factor changing. Scanning motor 33 is used to move exposure lamp 4 and the first to third mirrors for original scanning. Shutter motor 34 is used to move a shutter (not shown) for adjusting the width of charging of photosensitive drum 10 by means of main charger 11 at the time of scale factor changing. Developing motor 35 and drum motor 36 are used to drive a developing roller and other components of developing device 12 and drum 10, respectively. Fixing motor 37 is used to drive conveyor belt 22, fixing rollers 23, and exit rollers 24. Paper supply motor 38 serves to drive paper-supply rollers 15 and 16, while sheet feed motor 39 serves to drive aligning rollers 19. Fan motor 40 is used to drive cooling fan 29.

Figure 5:
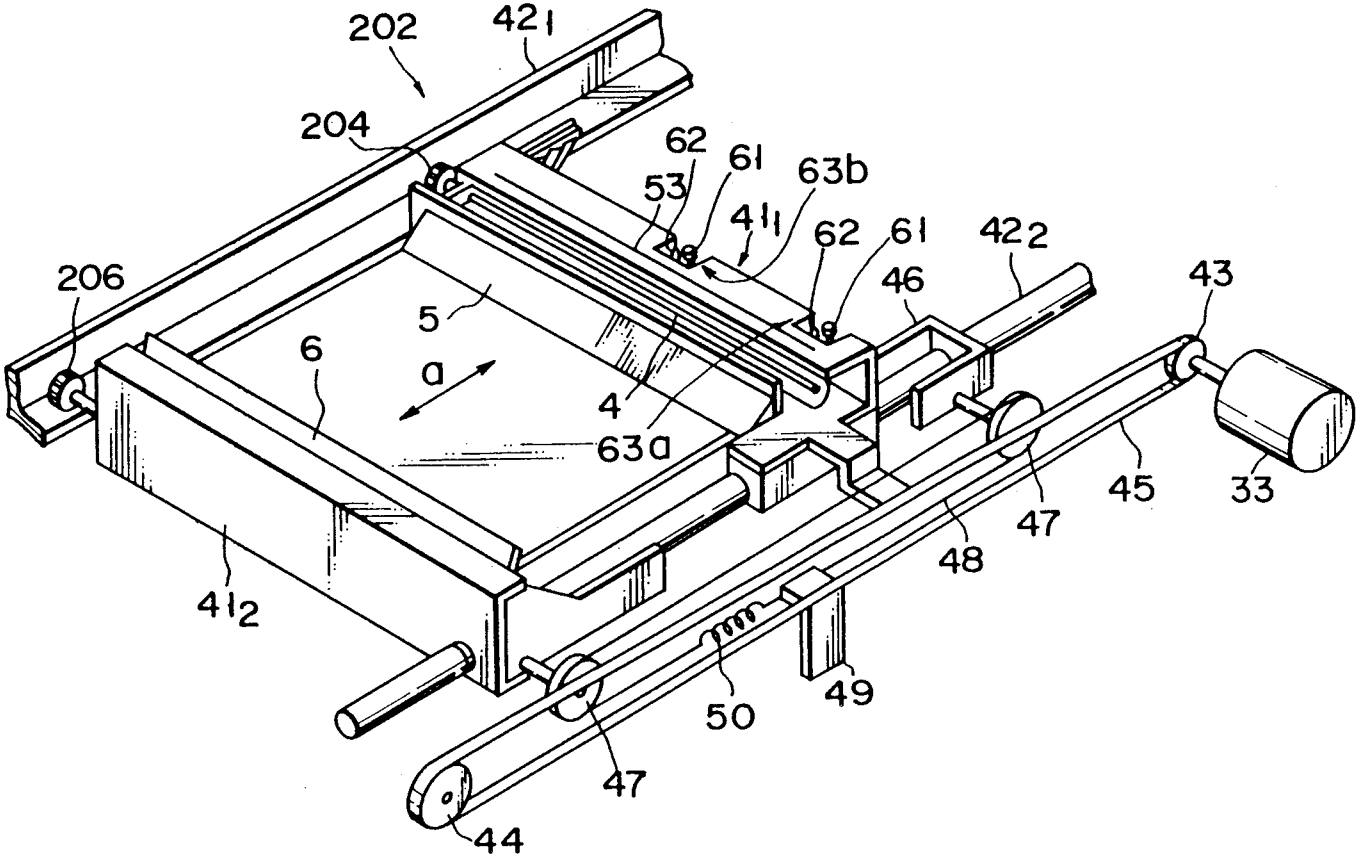
FIG. 5 is a perspective view of a drive mechanism for an optical system of the apparatus shown in FIG. 1.

FIG. 5 shows drive mechanism 202 for reciprocating lamp 4 and first to third mirrors 5 to 7. Lamp 4 and first mirror 5 is supported by first carriage $41_1$, while second and third mirrors 6 and 7 are supported by second carriage $41_2$. One end side of carriages $41_1$ and $41_2$ is supported by guide rail $42_1$ with the aid of rollers 204 and 206, respectively, while the other end side is supported by guide shaft $42_2$. Thus, carriages $41_1$ and $41_2$ are movable in the direction of arrow a. Numeral 33 designates the four-phase pulse motor. Pulley 43 is fixed to the rotating shaft of motor 33. It is situated near one end of shaft $42_2$. Idle roller 44 is located near the other end of shaft $42_2$. Endless belt 45 is passed around and between pulley 43 and roller 44. One end of first carriage $41_1$ is fixed to the middle portion of belt 45.

Second carriage $41_2$ includes guide portion 46 which is guided by guide shaft $42_2$. Portion 46 is provided with two rotatable pulleys 47 which are rotatably arranged at a distance in the axial direction of shaft $42_2$. Wire 48 is passed around and between pulleys 47. One end of wire 48 fixed to fixed portion 49, while the other end is fixed to portion 49 by means of coil spring 50. The one end of first carriage $41_1$ is fixed to the middle portion of wire 48. When pulse motor 33 is rotated, belt 45 rotates to move carriage $41_1$. Accompanying this, second carriage $41_2$ is also moved. Since pulleys 47 then function as running blocks, carriage $41_2$ is moved in the same direction as and at half the speed of carriage $41_1$. The moving direction of each carriage can be changed by changing the rotating direction of pulse motor 33.

Figure 6:
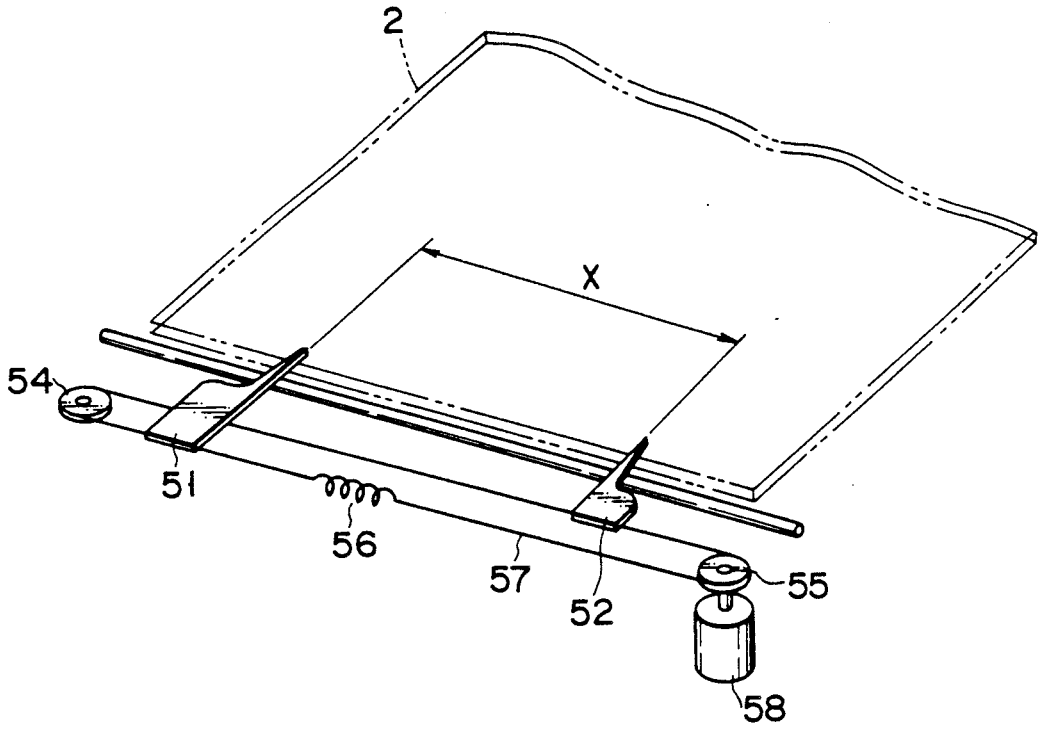
FIG. 6 is a perspective view of a drive mechanism for indexes of the apparatus shown in FIG. 1.

As shown in FIG. 6, a copy range corresponding to a specified paper sheet is indicated on original table 2. If the sheet size designated by means of cassette select key 30i and the copy scale factor designated by means of scale factor setting key 30h are (Px, Py) and K, respectively, copy range (x, y) is given by $x=Px/K$ and $y=-Py/K$. The x-direction length of range (x, y) is indicated by the distance between indexes 51 and 52 which are arranged on the underside of original table 2. The y-direction length of range (x, y) is indicated by the distance between fixed scale 21 and scale 53, which is located on the upper surface portion of first carriage $41_1$ (shown in FIG. 5).

Indexes 51 and 52 are fixed to wire 57, which is passed around and between pulleys 54 and 55 on the rear and front sides, respectively, of the original table. Wire 57 is an endless wire looped by means of spring 56. Pulley 55 is fixed to the rotating shaft of motor 58. The distance between indexes 51 and 52 can be changed by driving motor 58 in accordance with the x-direction length of the copy range obtained in the aforementioned manner.

As motor 33 is driven in accordance with the sheet size and the copy scale factor, first carriage $41_1$ is moved to a predetermined position (home position corresponding to the scale factor). When copy key 30a is operated, first carriage $41_1$ is moved toward second carriage $41_2$ to reach a scanning start position. Thereafter, exposure lamp 4 is lit, and carriage $41_1$ is moved away from carriage $41_2$. When scanning original G is finished in this manner, lamp 4 is put off, and first carriage $41_1$ is returned to the home position.

Figure 7:
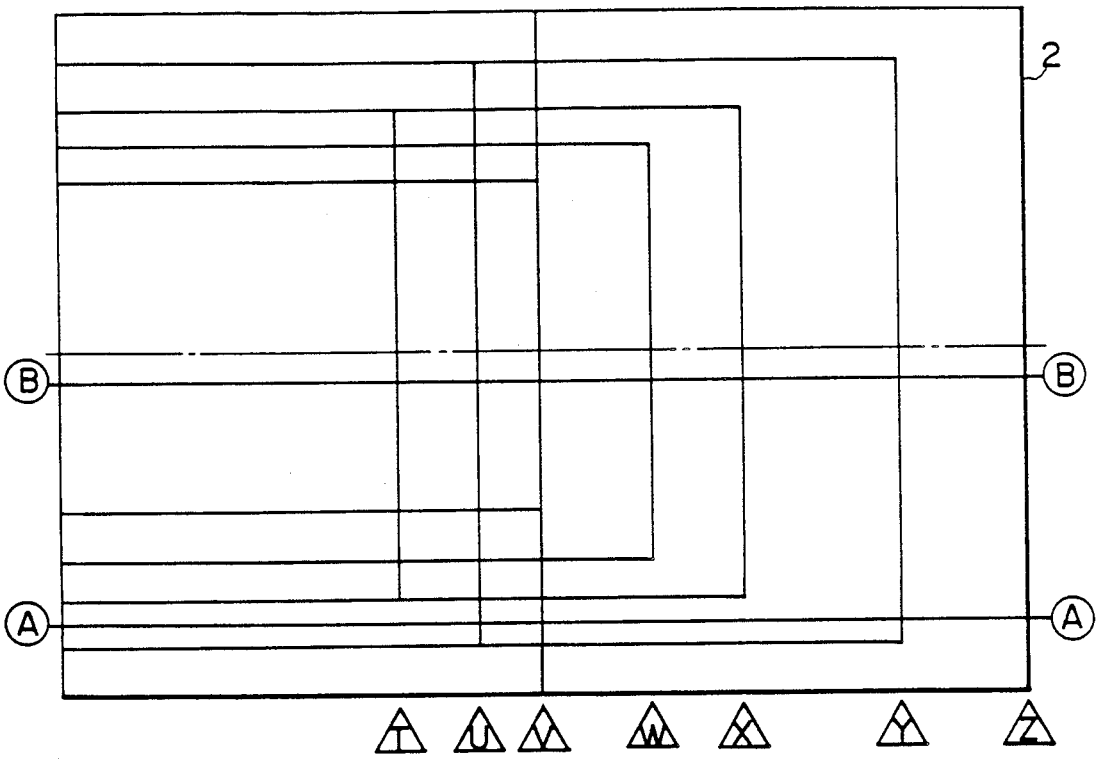
FIG. 7 is a diagram for illustrating an operation for original size detection of the apparatus shown in FIG. 1.

As shown in FIG. 5, first carriage $41_1$ is provided with original detectors 63a and 63b for detecting the original size. Each detector is composed of light sensing element 61, e.g., an image line sensor, and light emitting element 62 formed of a light emitting element. Detectors 63a and 63b are situated so that they can move (scan) along straight lines A—A and B—B, respectively, with respect to original table 2, as shown in FIG. 7. Thus, when copy key 30a is operated, first carriage $41_1$ moves from its home position toward second carriage $41_2$ to be situated at the scanning start position. When carriage $41_1$ is moved from this position so as to move away from carriage $41_2$, and if original detectors 63a and 63b are actuated, scanning for the detection of the original size is effected. When this scanning is finished, the operation of detectors 63*a* and 63*b* is stopped, and first carriage $41_1$ is moved to the scanning start position. Thereafter, exposure lamp 4 is lit and moved away from second carriage $41_2$. When the scanning for the image formation on original G is finished in this manner, lamp 4 is put off, and carriage $41_1$ is returned to the home position.

Figure 8:
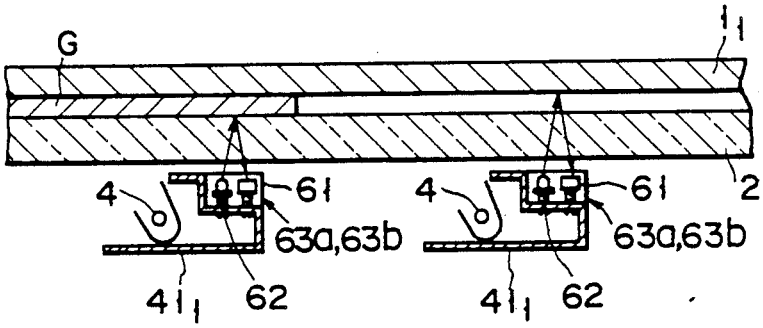
FIG. 8 is a diagram for illustrating an original detector of the apparatus shown in FIG. 1.

As first carriage $41_1$ is thus moved away from second carriage $41_2$ before the original scanning, original G and original cover $1_1$ are irradiated by light emitting elements 62, as shown in FIG. 8. As a result, light beams reflected by original G and cover $1_1$ are transmitted through original table 2 to be received by light sensing elements 61. The light beams received by elements 61 are converted thereby into electrical signals corresponding individually to the respective reflection factors of original G and cover $1_1$. These signals are supplied to processing unit 170 through main processor group 71, which will be mentioned later. The relationships between the moved position of first carriage $41_1$ and the levels of the reflected light beams, received by light sensing elements 61, are obtained in unit 170. Based on these relationships, the size of original G is automatically detected.

In this case, the presence of original G is discriminated by the change of spectra of the reflected light beams. As this discrimination is effected along the original scanning direction, the size of original G is detected. If original cover $1_1$ and original table 2 are not intimately in contact with each other, in the apparatus of this type, variations of the reflected light levels are extremely great. Accordingly, if original cover $1_1$ is left removed, or if it is prevented from being fully shut down by thick original G, such as a book, the presence of the original can be discriminated very easily. Thus, the size of original G can be easily detected by scanning two points (straight lines A—A and B—B) on original table 2 by means of their corresponding original detectors 63*a* and 63*b*, and then discriminating the presence of original G at various detecting positions T, U, V, W, X, Y, and Z, as shown in FIG. 7.

Originals G from size "A5" to "A3", for example, can be set on original table 2. Any of these originals is set with the center (indicated by dashed line in FIG. 7) of table 2 as a reference.

Figure 9:
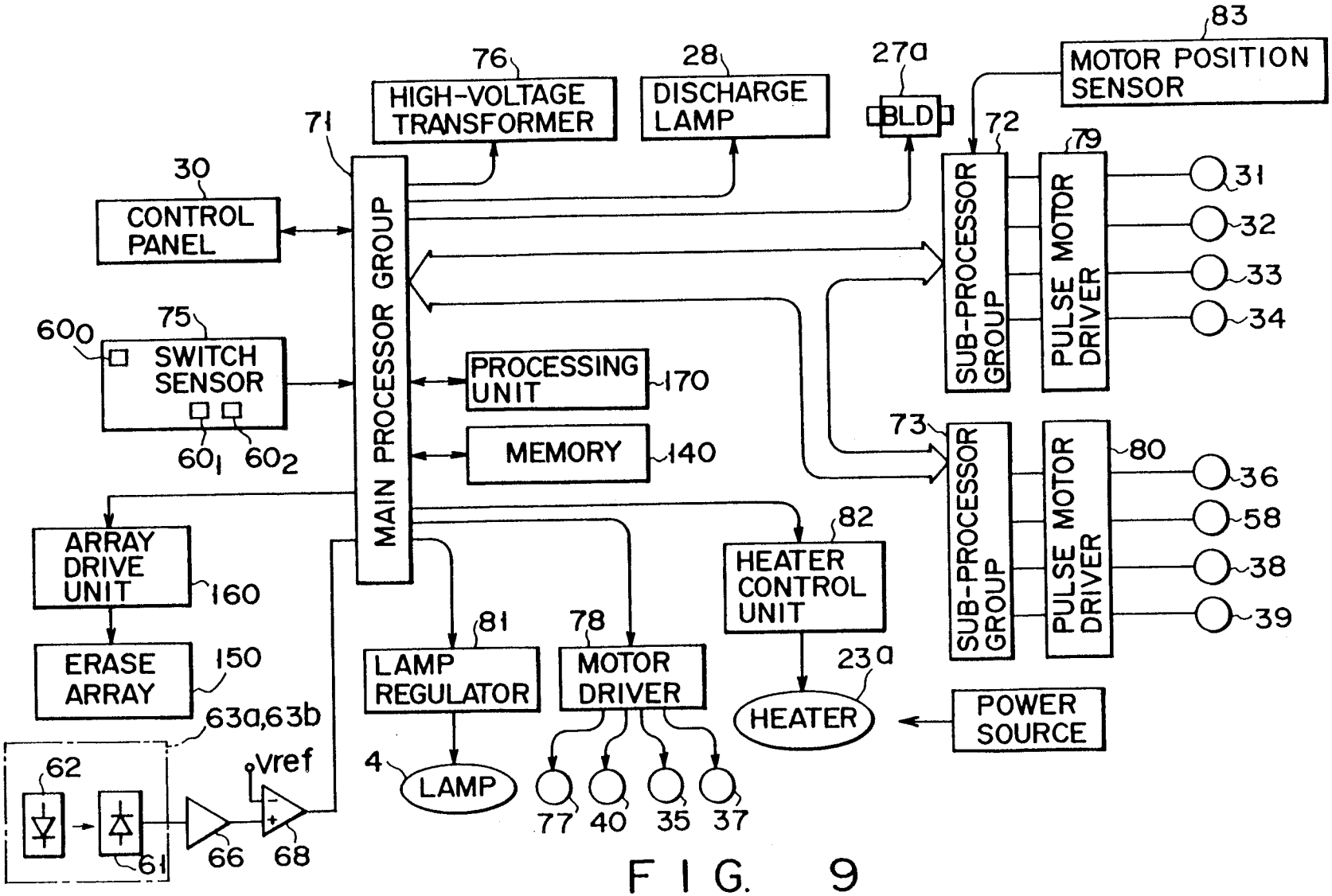
FIG. 9 is a circuit diagram of a control circuit of the apparatus shown in FIG. 1.

FIG. 9 shows a control circuit of the copying machine. Numeral 71 designates the main processor group. Group 71 detects input signals from control panel 30 and input devices 75, which includes various switches and sensors, such as cassette size detecting switches $60_1$ and $60_2$. Then, the main processor group controls high-voltage transformer 76 for driving the various chargers, discharge lamp 28, blade solenoid 27*a* of cleaner 27, heater 23*a* of fixing rollers 23, exposure lamp 4, and various motors 31 to 40 and 58, thus causing these elements to execute the aforementioned copying operation. At the same time, main processor group 71 controls original detectors 63*a* and 63*b*, memory 140, erase array 150, array drive unit 160, processing unit 170, etc., in accordance with the input signals from input devices 75, including cover detecting switch 600, thus causing these elements to execute the operation for erasing an undesired black image developed around that portion of the copy image (output image) which corresponds to the original image.

Motors 35, 37 and 40, among motors 31 to 40 and 58, and toner motor 77, which are used to supply the toner to developing device 12, is controlled by main processor group 71 through the medium of pulse motor driver 78. Motors 31 to 34 are controlled by first sub-processor group 72 through the medium of pulse motor driver 79. Motors 36, 39, 38 and 58 are controlled by second sub-processor group 73 through the medium of pulse motor driver 80. Exposure lamp 4 is controlled by main processor group 71 with the aid of lamp regulator 81. Heater 23*a* is controlled by group 71 with the aid of heater control unit 82. Drive/stop commands for these individual motors are delivered from main processor group 71 to first and second sub-processor groups 72 and 73. Status signals, indicative of the drive/stop state of the motors, and other signals are delivered from groups 72 and 73 to group 71. First sub-processor group 72 is supplied with position information from position sensor 83 for detecting the respective initial positions of motors 31 to 34. Sub-processor groups 72 and 73 are composed of, e.g., programmable interval timers, which count reference clock pulses in accordance with, e.g., a microcomputer and set points supplied therefrom, thereby controlling the phase shift interval time of the pulse motor.

Output signals (electrical signals) from original detectors 63*a* and 63*b* (light sensing elements 61) are supplied through amplifier 66 and comparator 68 to main processor group 71, and then to processing unit 170. In comparator 68, the outputs of amplifier 66 are compared to a reference voltage (Vref), which is used to correct fluctuations of the output levels of light sensing elements 61 attributable to variations of the sensitivity of the sensing elements or temperature changes.

Processing unit 170 is provided with position data, discrimination data, setting data, etc. The position data are used to calculate the positions (detecting positions T to Z) of first carriage $41_1$ in accordance with the number of pulses supplied to motor 33. The discrimination data are used to discriminate the original size in accordance with a combination of the output levels of original detectors 63*a* and 63*b* (presence of the original) at detecting positions T to Z obtained from the position data. The setting data are used to setting the erase range in accordance with an original image region (image size) based on the original size discriminated by the discrimination data and the copy scale factor designated by means of scale factor setting key 30*h* of control panel 30. Memory 140, erase array 150, and array drive unit 160 will be described in detail later.

FIG. 10 logically shows discrimination data used for the original size detection. The discrimination data are used to discriminate various original sizes in accordance with the combination of the levels of the signals delivered from original detectors 63*a* and 63*b* (presence of the original) at detecting positions (position data) T to Z when first carriage $41_1$ is moved. In FIG. 10, the output levels (at positions T to Z) of detectors 63*a* and 63*b*, moving along straight lines A—A and B—B, respectively, on original table 2 shown in FIG. 7, are indicated by circles and crosses. Each circle represents a case in which the output level corresponding to the reflected light beam from original G, i.e., the presence of the original, is discriminated. Each cross indicates a case in which the output level corresponding to the reflected light beam from the region outside original G, i.e., the absence of the original, is discriminated.

The following is a description of the operation for detecting the size of original G. Processing unit 170 determines the position of first carriage $41_1$ on the basis of the number of pulses of motor 33 and the position data. The presence of original G at detecting positions T, U, V, W, X, Y, and Z is determined by the respective output levels of original detectors 63*a* and 63*b*. Further, the size of original G is detected in accordance with the results of the determination (combination of the output levels of detectors 63*a* and 63*b* at detecting positions T to Z) and the discrimination data.

Figure 11A:
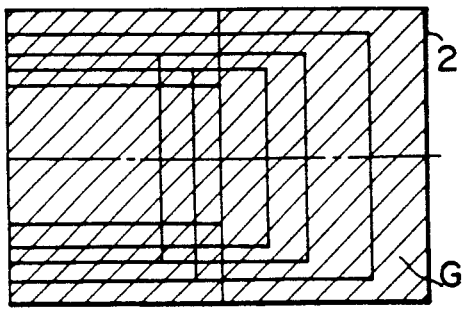
FIGS. 11A/to 11H show examples of the original size detection of the apparatus shown in FIG. 1.

If original G of size "A3" is set on original table 2, as shown in FIG. 11A, for example, the presence (circle) of the original is detected from the outputs of original detectors 63*a* and 63*b* when first carriage $41_1$ is situated at any of detecting positions T to W. This conclusion can be reached only if original G is of size "A3," as shown in FIG. 10. In this case, original G is identified as an original of size "A3" by processing unit 170.

Figure 11E:
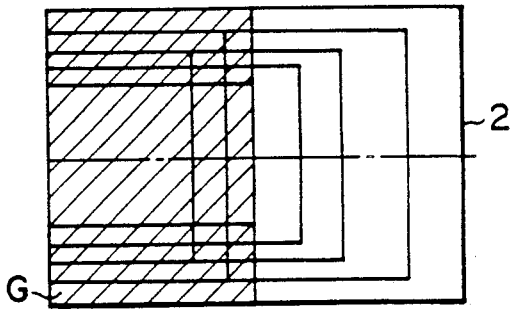
Figure 11B:
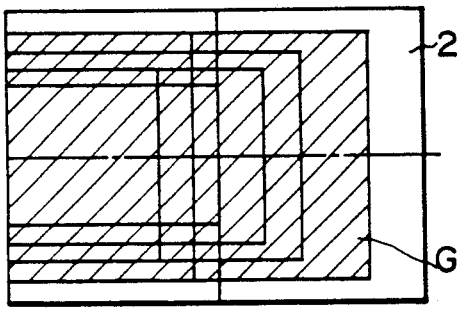
Figure 11F:
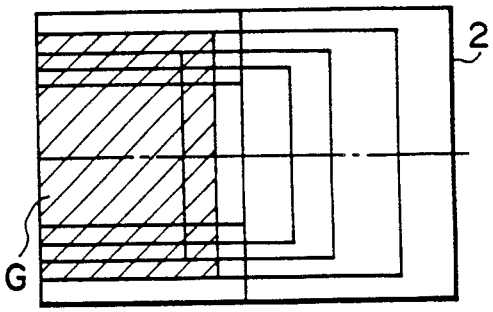
Figure 11C:
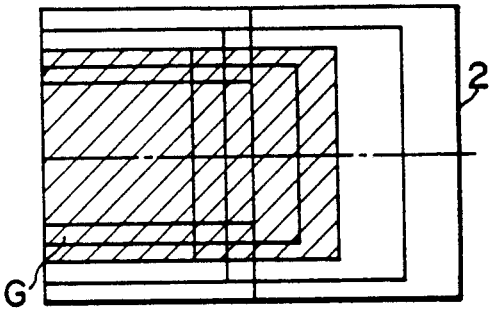
Figure 11G:
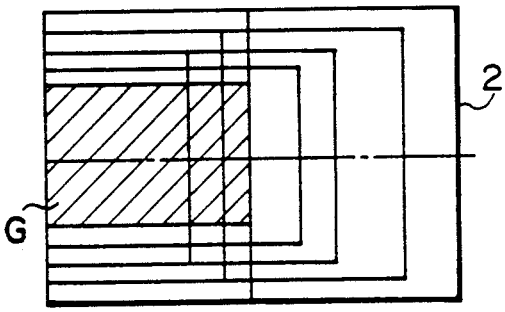
Figure 11D:
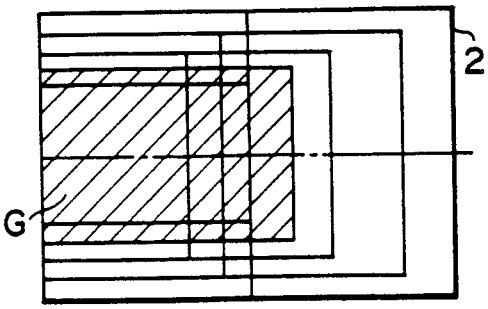

If original G of size "A4-vertical" is set on original table 2, as shown in FIG. 11E, for example, the presence (circle) of the original is detected from the outputs of original detectors 63*a* and 63*b* when first carriage $41_1$ is situated at any of detecting positions T to V. When carriage $41_1$ is situated at any of detecting positions W to Z, the absence (cross) of the original is detected from the outputs of the detectors. This conclusion can be reached only if original G is of size "A4-vertical," as shown in FIG. 10. In this case, original G is identified as an original of size "A4-vertical" by processing unit 170.

Figure 11H:
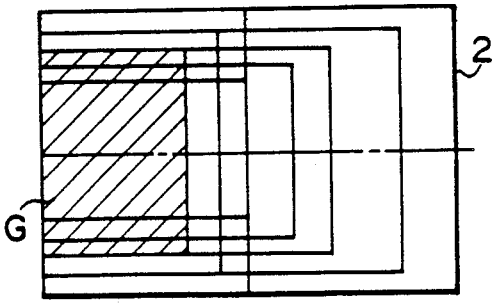

If original G of size "A5-vertical" is set on original table 2, as shown in FIG. 11H, for example, the presence (circle) of the original is detected from the output of original detector 63*b* when first carriage $41_1$ is situated at detecting position T. The absence (cross) of the original is detected from the output of detector 63*a* when carriage $41_1$ is situated at position T, and from the outputs of detectors 63*a* and 63*b* when carriage $41_1$ is situated at any of positions U to Z. This conclusion can be reached only if original G is of size "A5-vertical," as shown in FIG. 10. In this case, original G is identified as an original of size "A5-vertical" by processing unit 170.

Thus, the size of original G is discriminated on the basis of the discrimination data by determining the presence of the original at detecting positions T to Z, in accordance with the variation of the level of the reflected light beam from the original surface produced by the irradiation. In this case, the presence of original G is determined by the change of the spectra of the reflected light beams, as mentioned before. Therefore, if original cover 11 is not fully shut down, for example, the levels of the reflected light beams from original G and the region outside the original are substantially different. Accordingly, the presence of original G can be easily determined by the output levels of original detectors 63*a* and 63*b*. The original size can be detected very easily by thus determining the presence of original G at detecting positions T to Z. FIGS. 11B, 11C, 11D, 11F and 11G indicate cases in which originals of sizes "B4," "A4-horizontal," "B5-horizontal," "B5-vertical," and "A5-horizontal" are set, respectively. In any of these cases, the size of original G can be accurately detected on the basis of a combination of the position data on first carriage $41_1$ and information indicative of the presence of the original, i.e., the output levels of two detectors 63*a* and 63*b* at detecting positions T to Z, as shown in FIG. 10.

Figure 12:
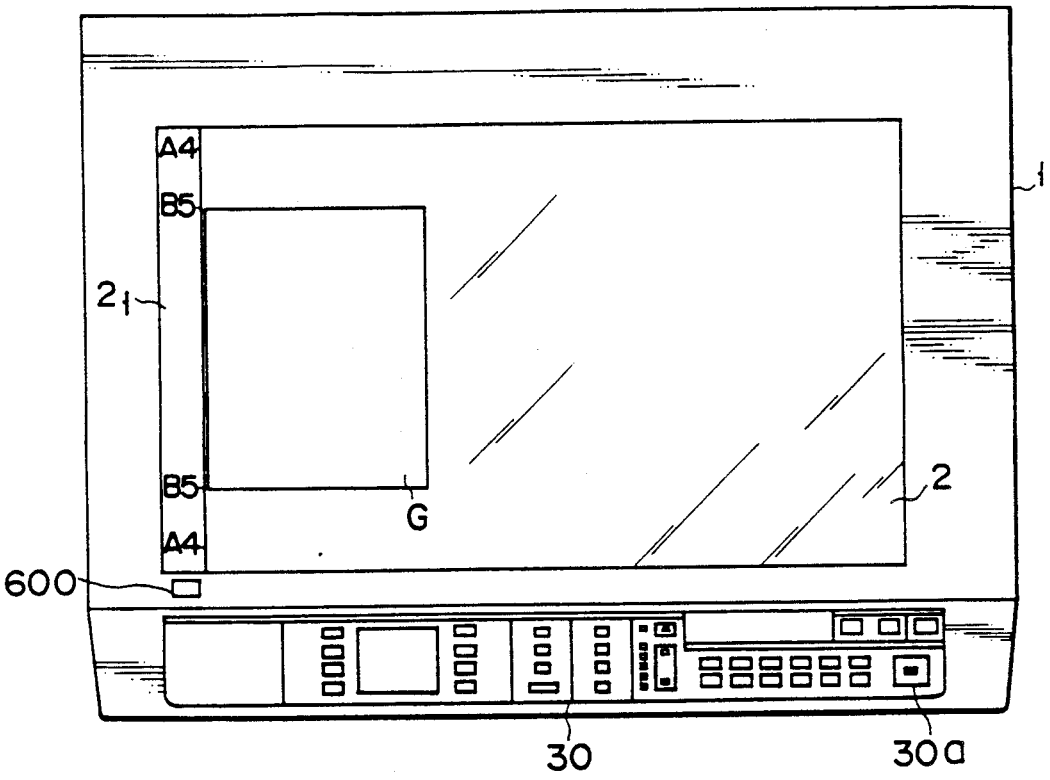
FIG. 12 is a diagram for illustrating a method for setting an erase range of the apparatus shown in FIG. 1.
Figure 13:
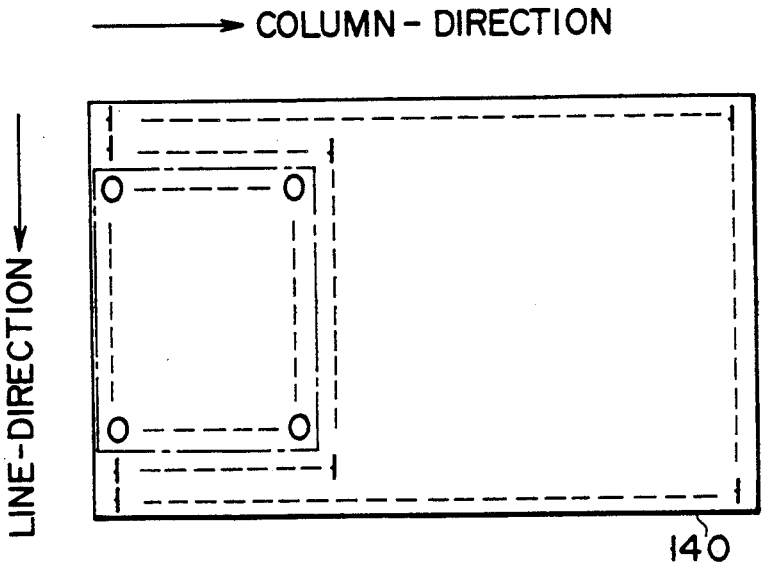
FIG. 13 is a diagram for illustrating the contents of a memory of the apparatus shown in FIG. 1.

Referring now to FIGS. 12 and 13, a method for setting the erase range, using the results of detection of the original size, will be described. If it is detected that original cover $1_1$ is not fully shut down, processing unit 170 sets an erase range such that the peripheral region of the copy image outside the region corresponding to the original image is to be erased, on the basis of the copy image region (image size) corresponding to the original size, obtained in accordance with the discrimination data, and the copy scale factor, designated by means of scale factor setting key 30*h* of control panel 30. This erase range is selected from set data in accordance with the image size, and is stored in memory 140 through the medium of main processor group 71. As a result, a low-level signal "0" is stored in the area of memory 140 corresponding to the original image region, while a high-level signal "1" is stored in the area corresponding to the region (no-image region) outside the image region. Thus, memory 140 has a capacity a little greater than the maximum copiable original size. If original G is set on original table 2 with the scale factor set to 100% (for full-size copy), as shown in FIG. 12, the low-level signal is stored in an address which corresponds to the original, while the high-level signal is stored in any of other addresses.

Figure 14:
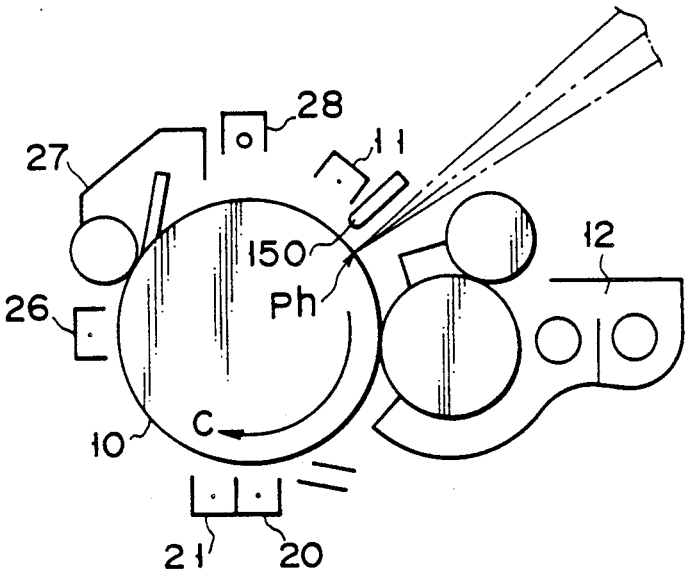
FIG. 14 is a diagram for illustrating the arrangement of an erase array of the apparatus shown in FIG. 1.
Figure 15:
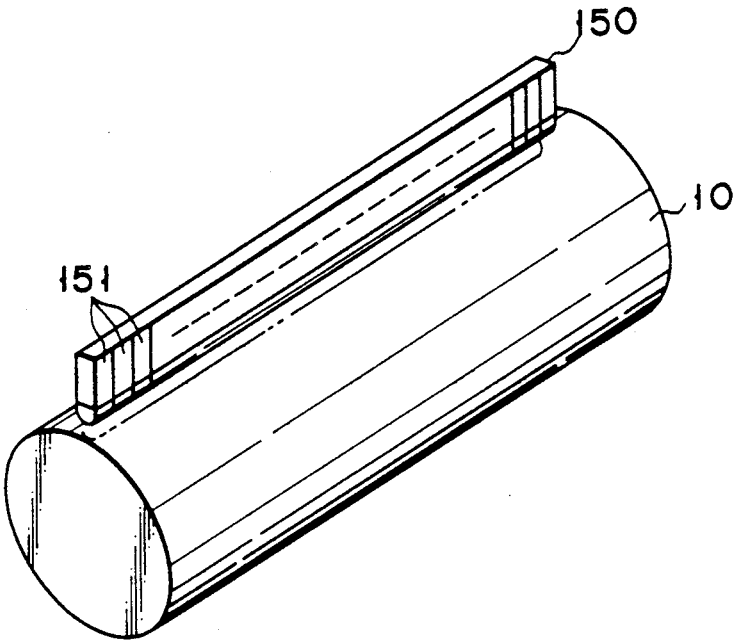
FIG. 15 is a perspective view showing the relative positions of the erase array and a photosensitive drum of the apparatus shown in FIG. 1.

As shown in FIG. 14, erase array 150 is located close to photosensitive drum 10, between main charger 11 and exposure region Ph. It includes a plurality of shading cells 151 arranged at right angles to the rotating direction of drum 10, as shown in FIGS. 15 and 16. Light emitting element 152, e.g., a light emitting diode, is disposed inside each cell 151, as shown in FIGS. 17A and 17B. An opening is formed on that side of each cell which faces drum 10. Lens 153 for converging a light beam from element 152 on the surface of photosensitive drum 10 is disposed at the opening portion. The number of light emitting elements 152 arranged in erase array 150 is equivalent to, for example, the column-direction capacity of memory 140. If the distance between each two adjacent element 152 and the element number are P1 and N, respectively, the overall length of array 150 is $Q=N\times P_1$.

Figure 18:
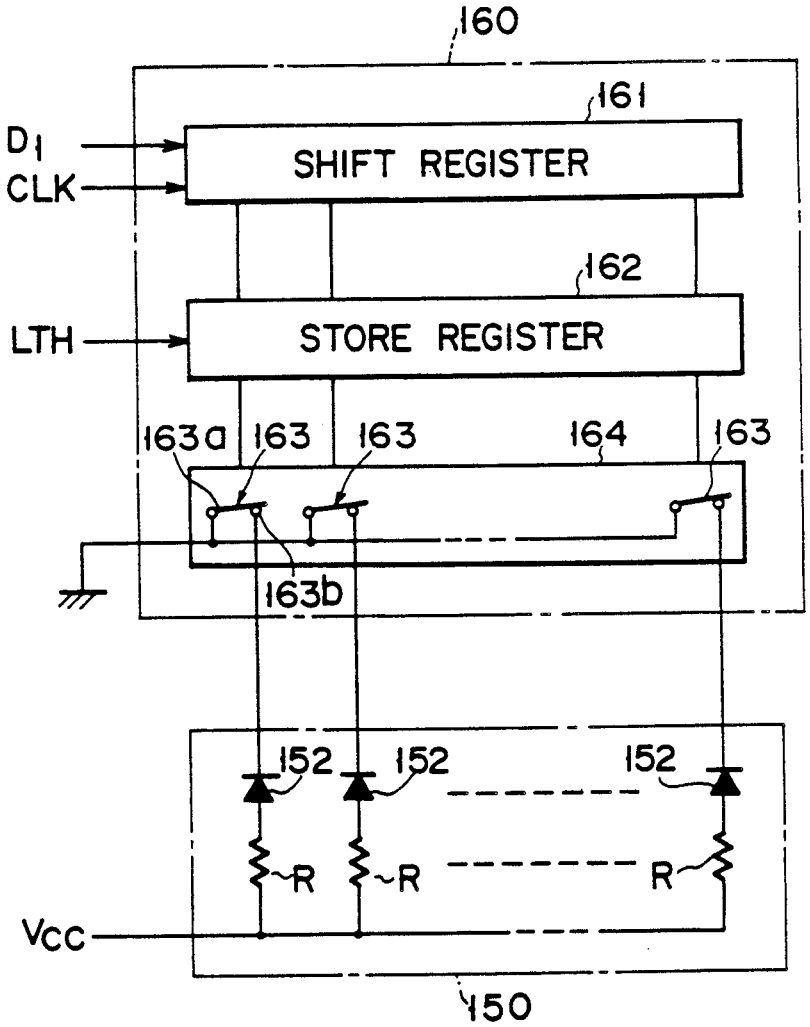
FIG. 18 is a front view of a drive unit for the erase array shown in FIG. 14.

Erase array 150 is driven by array drive unit 160 mentioned before. As shown in FIG. 18, unit 160 includes shift register 161, store register 162, and switch circuit 164. Register 161 has as many bits as the column-direction bits of memory 140. Register 162 serves to maintain the contents of register 161. Circuit 164 is composed of a plurality of switch elements 163 which are on-off controlled by means of output signals from store register 162. Each switch element 163 includes grounded movable contact 163*a* and fixed contact 163*b*. Contact 163*b* is connected to the cathode of each corresponding light emitting element 152 of erase array 150. The anode of each element 152 is connected to power source $V_{CC}$ through current limiting resistor R.

After the erase range is set in the aforementioned manner, first carriage $41_1$, photosensitive drum 10, etc. are actuated, and memory 140 successively reads out data for one column along a line (see FIG. 13). Data $D_1$ read in this manner are transferred to shift register 161 of array drive unit 160 by means of clock signal CLK. When a charged portion of photosensitive drum 10 reaches erase array 150 after the one-column data are transferred to register 161, latch signal LTH is delivered from main processor group 71. In response to signal LTH, the data stored in shift register 161 are supplied to store register 162. Since array 150 is located between charger 11 and exposure region Ph, the output timing of latch signal LTH is controlled so that the one-column data outputted by memory 140 are supplied to register 162 before a point of time corresponding to $\theta_1/\omega$, where $\omega_1$ is the angle between erase array 150 and region Ph, and $\theta$ is the angular velocity at which photosensitive drum 10 rotates.

Switch elements 163 of switch circuit 164 are controlled by means of the output signals of store register 162. More specifically, elements 163 are turned on when the output level of register 162 is high, and are turned off when the output level is low. Thus, light emitting elements 152, connected individually to switch elements 163, are lit and put off when elements 163 are turned on and off, respectively. Accordingly, those parts of the charged portion of photosensitive drum 10 at which elements 163 are lit are de-electrified. Even if the de-electrified parts are exposed thereafter, no electrostatic latent image can be formed thereon, that is, the image is erased. Thereafter, the data in memory 140 are read out column by column in like manner so that light emitting elements 152 of erase array 150 are lit corresponding to the region of the copy image outside the region which corresponds to the original image. Thus, the undesired black image around the original image is erased.

Figure 19:
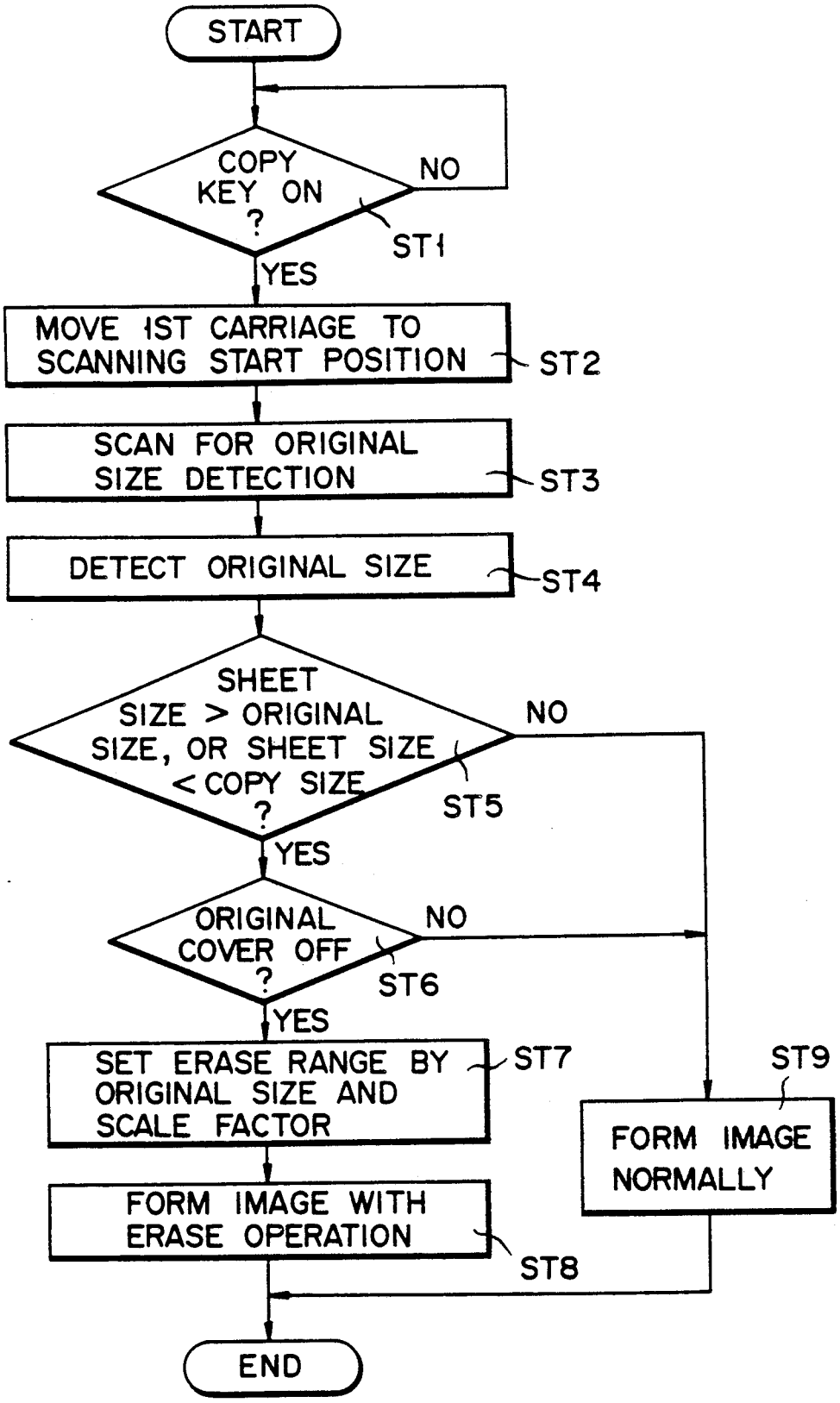
FIG. 19 is a flow chart for illustrating the operation of the apparatus shown in FIG. 1.

Referring now to the flow chart of FIG. 19, the operation of the aforementioned arrangement will be described.

In step ST1, whether copy key 30*a* of control panel 30 is operated after original G is set on original table 2 is determined. If key 30*a* is on, the program proceeds to step ST2.

In step ST2, motor 33 is driven under the control of first sub-processor group 72 through pulse motor driver 79, so that first carriage $41_1$ is moved from the home position, corresponding to the copy scale factor, toward second carriage $41_2$ to reach the scanning start position. Thereafter, the program proceeds to step ST3.

In step ST3, original detectors 63*a* and 63*b* are actuated under the control of main processor group 71, and first carriage $41_1$ is moved away from second carriage $41_2$, whereupon scanning for the original size detection is started. As carriage $41_1$ moves in this manner, detectors 63*a* and 63*b* are moved along straight lines A—A and B—B (shown in FIG. 7), respectively, on original table 2. Thereupon, the reflected light beams from the original surface, produced by the irradiation by means of light emitting elements 62, are received by light sensing elements 61. The outputs of elements (original detectors 63*a* and 63*b*) are converted into voltage signals by means of amplifier 66, and are then corrected in accordance with the reference voltage (Vref) in comparator 68. Thereafter, the program proceeds to step ST4.

In step ST4, the outputs of comparator 68 are supplied through main processor group 71 to processing unit 170, and are used for the original size detection as the presence of original G at detecting positions T, U, V, W, X, Y, and Z is determined. Thus, in unit 170, the position of first carriage $41_1$ is detected from the number of pulses of motor 33 and the position data, and the presence of original G at positions T to Z is determined by checking the output levels of original detectors 63*a* and 63*b*. The size of original G is discriminated on the basis of the result of this determination and the discrimination data. Thereafter, the program proceeds to step ST5.

In step ST5, the image size, i.e., the detected original size (for full-size copy), or the copy size (for reduced- or enlarged-size copy), based on the original size and the scale factor designated by means of scale factor setting key 30*h*, is compared to the sheet size designated by cassette select key 30*i*. If it is concluded, as a result of this comparison, that the original size or copy size is smaller than the sheet size, the program proceeds to step ST6. If the original size or copy size is equal to or greater than the sheet size, the program proceeds to step ST9.

In step ST6, whether copy key 30*a* is operated with original cover $1_1$ not fully shut down is determined by, for example, an input from cover detecting switch 600. If it is concluded that the original size or copy size is smaller than the sheet size and that cover $1_1$ is not fully shut down, the program proceeds to step ST7. If it is concluded that the original cover is fully shut down, the program proceeds to step ST9.

In step ST7, the erase range is set in accordance with the image size, i.e., the original size, and the scale factor, and a high-level signal is stored in an address of memory 140 which corresponds to the erase range. Thereafter, the program proceeds to step ST8.

Figure 20A:
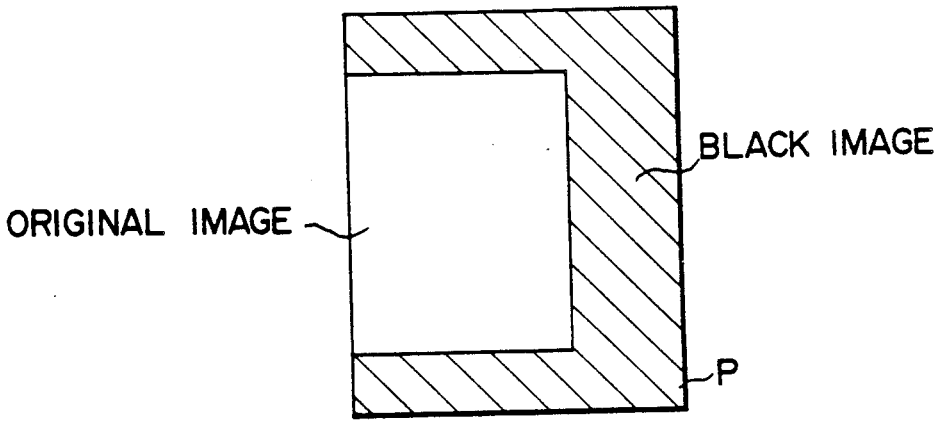
FIG. 20A is a diagram showing a case in which an undesired black image develops on a copy image, in the apparatus shown in FIG. 1.
Figure 20B:
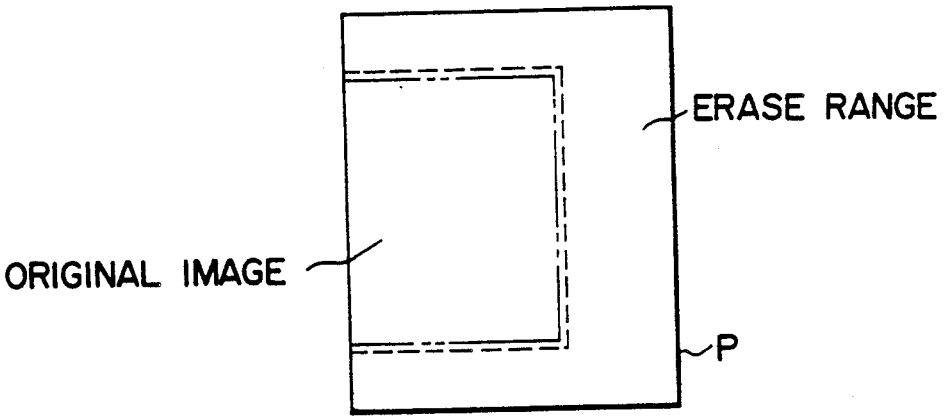
FIG. 20B is a diagram showing a case in which the undesired black image is erased from the copy image, in the apparatus shown in FIG. 1.

In step ST8, an image forming operation is started accompanying an erase operation. Lamp 4 is lit under the control of main processor group 71 through lamp regulator 81, and motor 33 is driven under the control of first sub-processor group 72 through pulse motor driver 79. Thereupon, first carriage $41_1$ is moved from the scanning start position so as to become more distant from carriage $41_2$, so that the original is scanned for image formation. Also, motor 36 and the like are driven under the control of second sub-processor group 73 through pulse motor driver 80, so that photosensitive drum 10 is actuated, and erase array 150 is driven by means of array drive unit 160. Thus, light emitting elements 152 are lit in accordance with data from memory 140, as mentioned before. As a result, the surface charge on photosensitive drum 10 charged by means of main charger 11 is removed corresponding to the erase range in which elements 152 are lit. No electrostatic latent image can be formed on that portion of the charged region of drum 10 which is de-electrified by erase array 150, even though the de-electrified portion is exposed thereafter. Therefore, when original cover $1_1$ is not fully shut down, and if the size of original G is smaller than the sheet size designated by means of cassette select key 30*i*, or if the copy size corresponding to the copy scale factor set by means of scale factor setting key 30*h* is smaller than the sheet size although the original and the sheet are equal in size, there is no possibility of a undesired black image (hatched black region of FIG. 20A) developing around that region of the copy image on sheet P corresponding to the original image, as shown in FIG. 20B. Thus, a beautiful copy image can always be obtained as a hard copy.

Original G used is not limited to a sheet-like form. Even if it is a thick book original, such that original cover $1_1$ cannot fully contact original table 2, the undesired black image around the region of the copy image corresponding to the original image can be erased, so that a beautiful copy image can be obtained as a hard copy. In the embodiment described above, part of the original image (defined by broken lines) is also erased (the erase range is indicated by two-dot chain line), as shown in FIG. 20B, due to diffusion of the emitted light beams from light emitting elements 52 and other causes. Thus, the undesired black image around the region corresponding to the original image can be thoroughly erased from the copy image.

In step ST9, a normal copying operation is performed without being accompanied by the aforesaid erase operation. Thus, if original cover $1_1$ is fully shut down, the undesired black image cannot develop around the region of the copy image corresponding to the original image, so that the erase operation is unnecessary. If it is concluded by cover detection that cover $1_1$ is fully shut down, therefore, the erase operation can be omitted.

When copy images are formed in accordance with the set number of copies in this manner, a series of operations is finished, and the copying machine is kept on stand-by.

When the size of the original on the original table is read, and if it is concluded by comparison that the image formed in accordance with the original size is smaller in size than the copying sheet, as described above, the image developed around the region of the copy image corresponding to the original image is erased by forcing an undesired electric charge to be removed from photosensitive drum 10.

As first carriage $41_1$ moves, the reflected light beams from the original surface, produced by the irradiation by means of light emitting elements 62, are received by light sensing elements 61. As the output levels of elements 61 vary, the presence of the original is determined along the scanning direction of carriage $41_1$. The original size is detected in accordance with the result of this determination. If the original size or copy size is smaller than the designated sheet size, the image developed around the region of the copy image corresponding to the original image is erased by removing the surface charge of photosensitive drum 10 except the region for image formation. Thus, even if original cover $1_1$ is not shut down, or is prevented from being fully shut down by the thickness of the original, for example, when the original size or the copy size is smaller than the sheet size, an undesired black image can be prevented from being wastefully produced around the copy image region corresponding to the original image by the toner. Accordingly, a beautiful, high-quality copy image can be obtained, and the developing agent can be prevented from being wastefully consumed for the copy image region outside the region corresponding to the original image.

Since the beautiful copy image, free of the undesired black image, can be obtained even with original cover $1_1$ off, moreover, the cover need not be shut down with every copying cycle.

In the embodiment described above, the erase operation is performed when original cover $1_1$ is not fully shut down, for example. If this operation is permitted at all times, however, an undesired black image can be prevented from developing despite the existence of stains, if any, on the inside of cover $1_1$.

In the above embodiment, moreover, the removal of original cover $1_1$ is detected by means of the input from cover detecting switch 600. Alternatively, however, it may be detected on the basis of, for example, the levels or intensity of the reflected lights. More specifically, if the brightness of the light from the region outside original G is lower than a predetermined level, then cover $1_1$ is regarded as off.

Further, the erase operation may be permitted only when the mode is designated in response to the input from control panel 30.

Furthermore, the state of original cover $1_1$ may be detected at the point of time when copy key 30*a* is operated. If it is concluded, in this case, that cover $1_1$ is fully shut down, scanning for the original size detection may be omitted.

Figure 21:
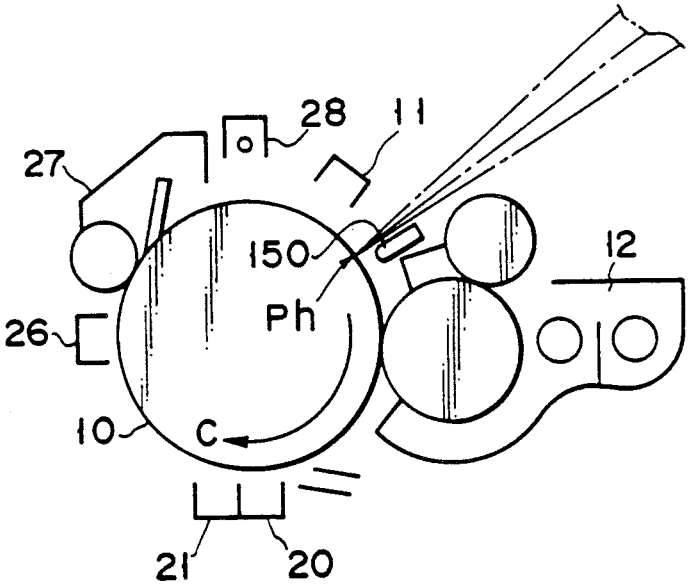
FIG. 21 is a diagram showing a modification of the arrangement of the erase array shown in FIG. 14.

The location of erase array 150 is not limited to the position shown in FIG. 14. As shown in FIG. 21, it may alternatively be located between exposure region Ph and developing device 12 so that a formed electrostatic latent image is erased in accordance with the erase range.

Figure 22:
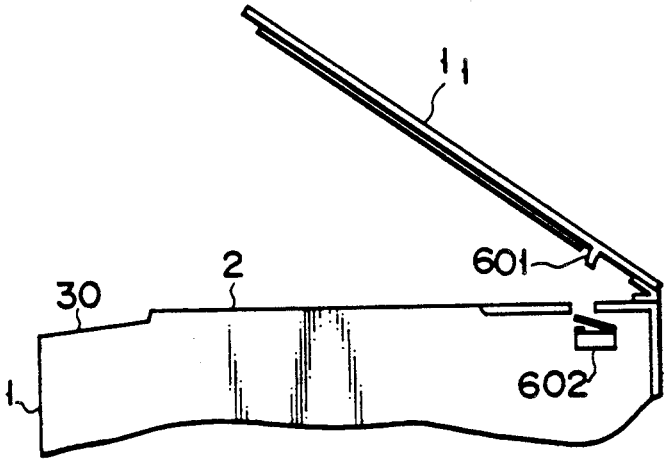
FIG. 22 is a diagram showing a modification of a cover detecting switch of the apparatus shown in FIG. 1.

The location of cover detecting switch 600 is not limited to the position shown in FIGS. 1 and 2. As shown in FIG. 22, it may alternatively be located on the proximal end portion of original cover $1_1$. Moreover, switch 600 is not limited to the combination of magnet $600_1$ and reed switch $600_2$, and may alternatively be formed of a combination of actuator 601 and microswitch 602 such that it can be turned on or off as cover $1_1$ is shut down or swung open, for example.

The arrangement of the present invention may be also applied to a case such that fixed scale $2_1$ does not serve as a reference for the original setting. In this case, the original size can be easily detected by changing the timing for the start of counting the number of pulses, for example, in accordance with the state of original G.

Referring now to FIGS. 23 to 33, a second embodiment of the present invention will be described. The following is a description of only those portions of the second embodiment which are different from their counterparts of the first embodiment.

Figure 23:
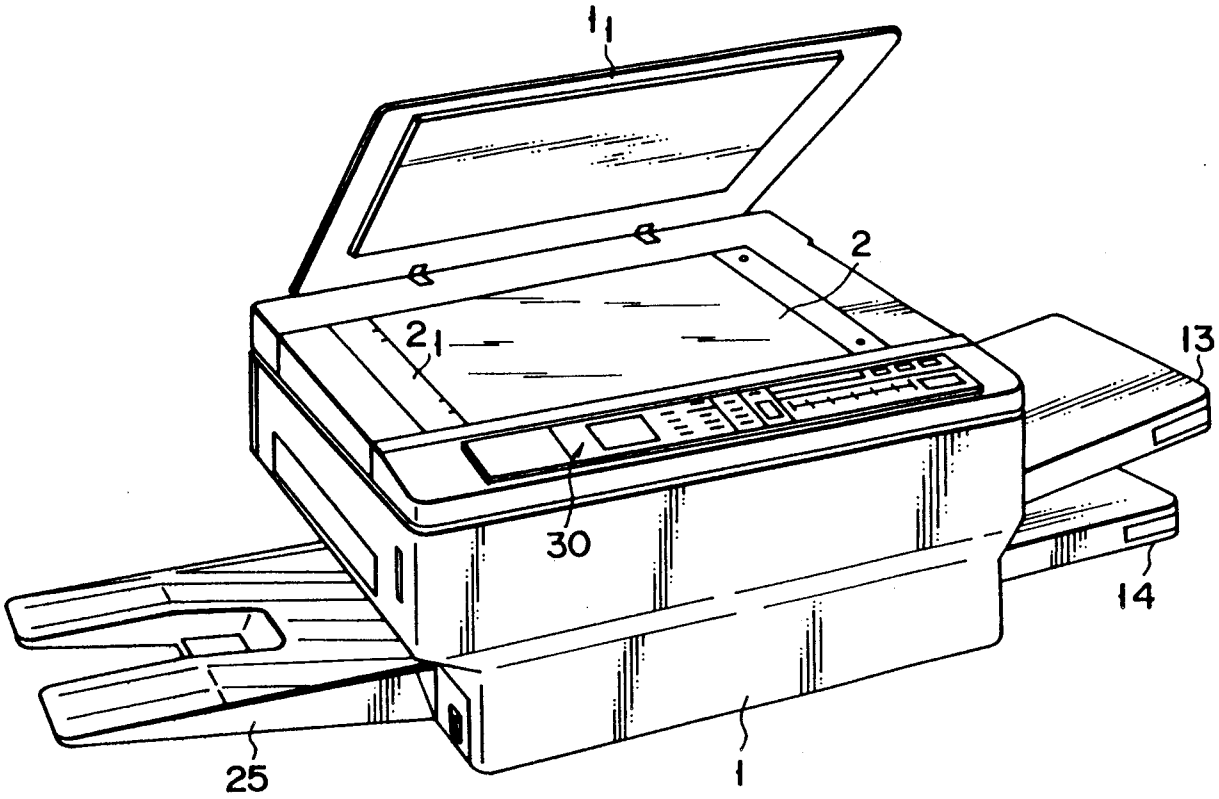
FIG. 23 is a perspective view showing a second embodiment of the copying machine as the image forming apparatus according to the present invention.
Figure 24:
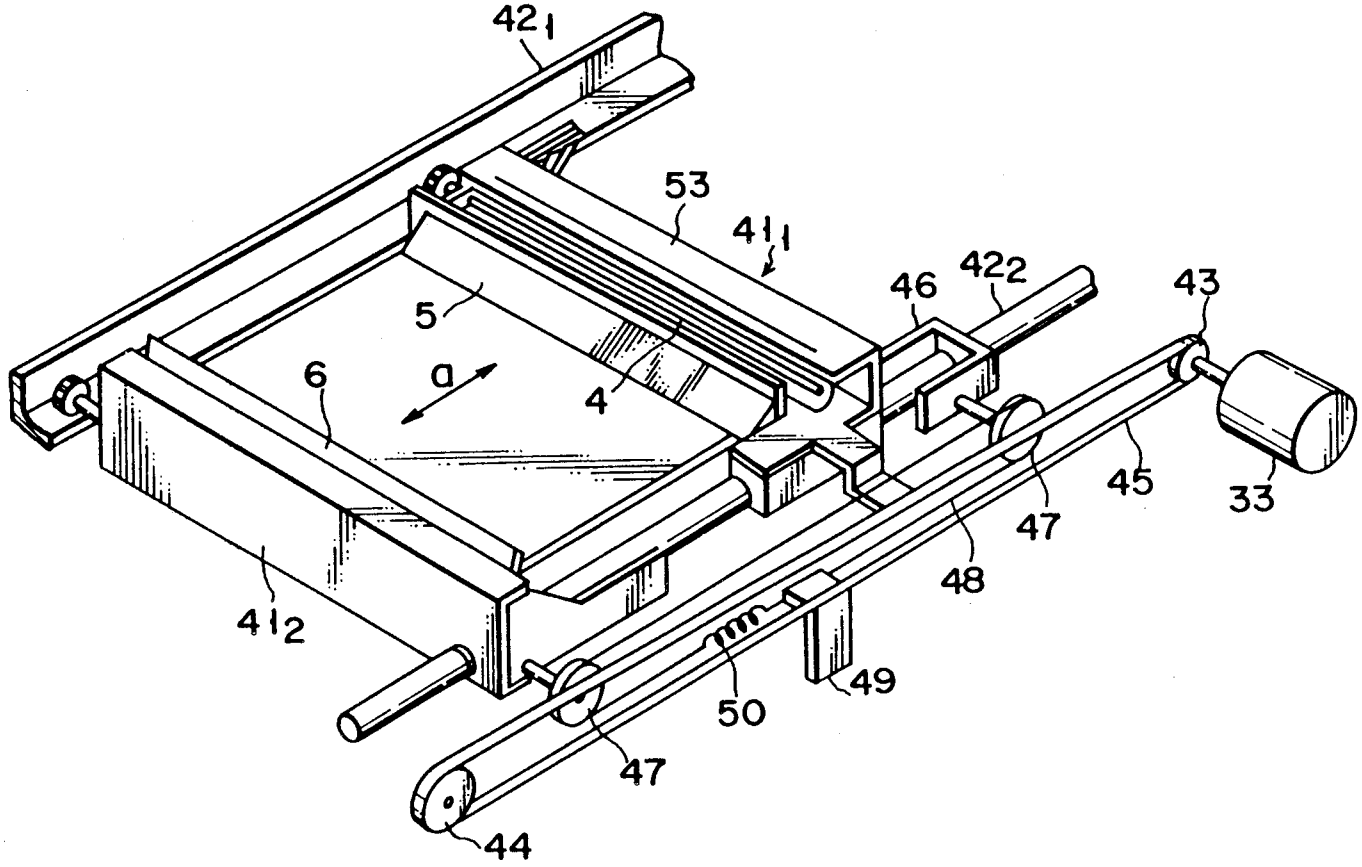
FIG. 24 is a perspective view of a drive mechanism for an optical system of the apparatus shown in FIG. 23.

As shown in FIGS. 23 and 24, cover detecting switch 600 and original detectors 63*a* and 63*b*, which are used in the first embodiment, are not provided in the second embodiment.

Figure 25:
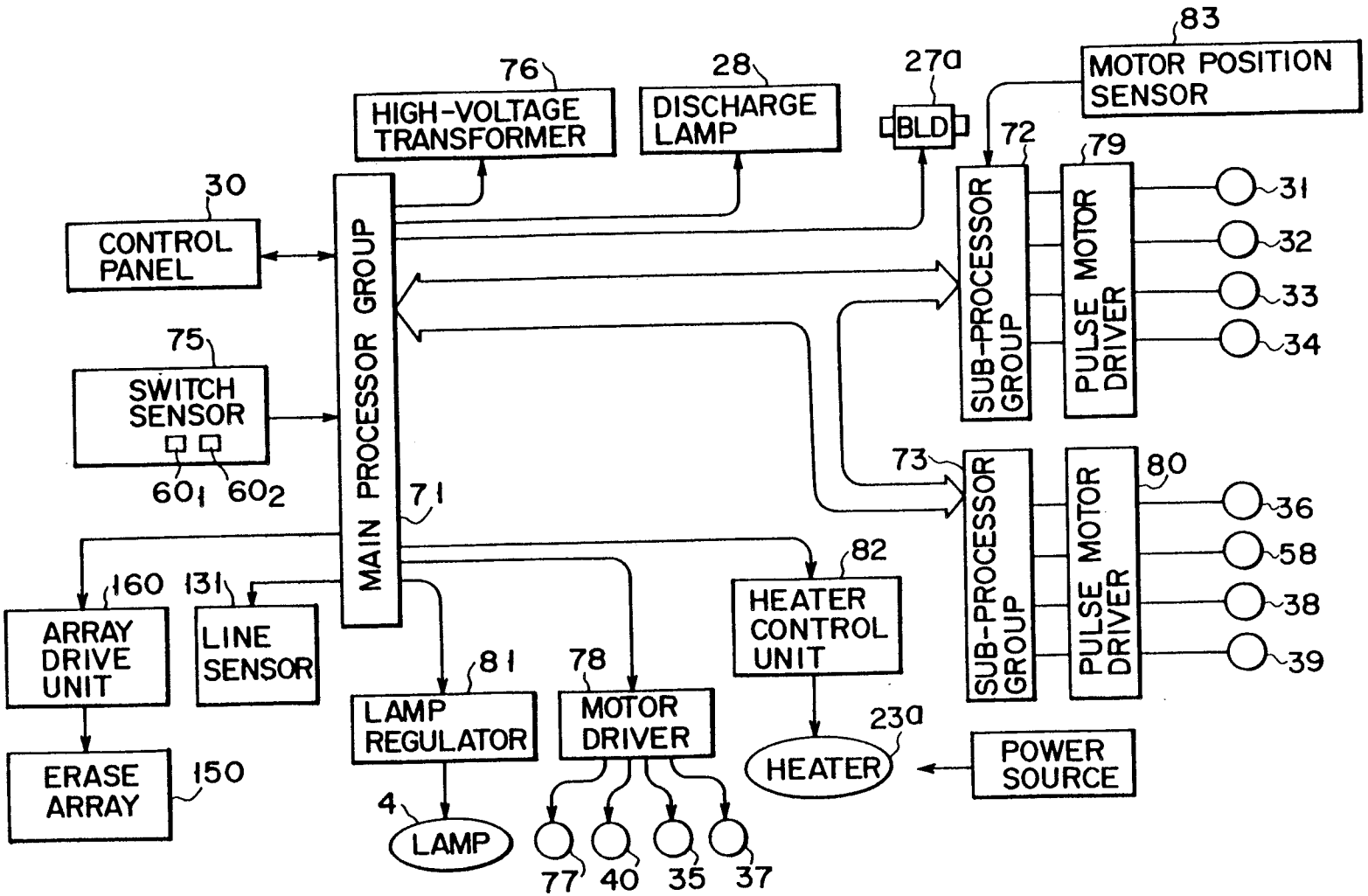
FIG. 25 is a circuit diagram of a control circuit of the apparatus shown in FIG. 23.

FIG. 25 shows a control circuit of a copying machine according to the second embodiment. Numeral 71 designates a main processor group. Group 71 detects inputs from control panel 30 and input devices 75, which includes various switches and sensors, such as cassette size detecting switches $60_1$ and $60_2$. Then, the main processor group controls high-voltage transformer 76 for driving the various chargers, discharge lamp 28, blade solenoid 27*a* of cleaner 27, heater 23*a* of fixing rollers 23, exposure lamp 4, and various motors 31 to 40 and 58, thus causing these elements to execute the aforementioned copying operation. Also, main processor group 71 controls line sensor 131, erase array 150, array drive unit 160, etc., thus causing these elements to execute operation for erasing an undesired black image developed around that portion of a copy image which corresponds to an image of an original.

Figure 26:
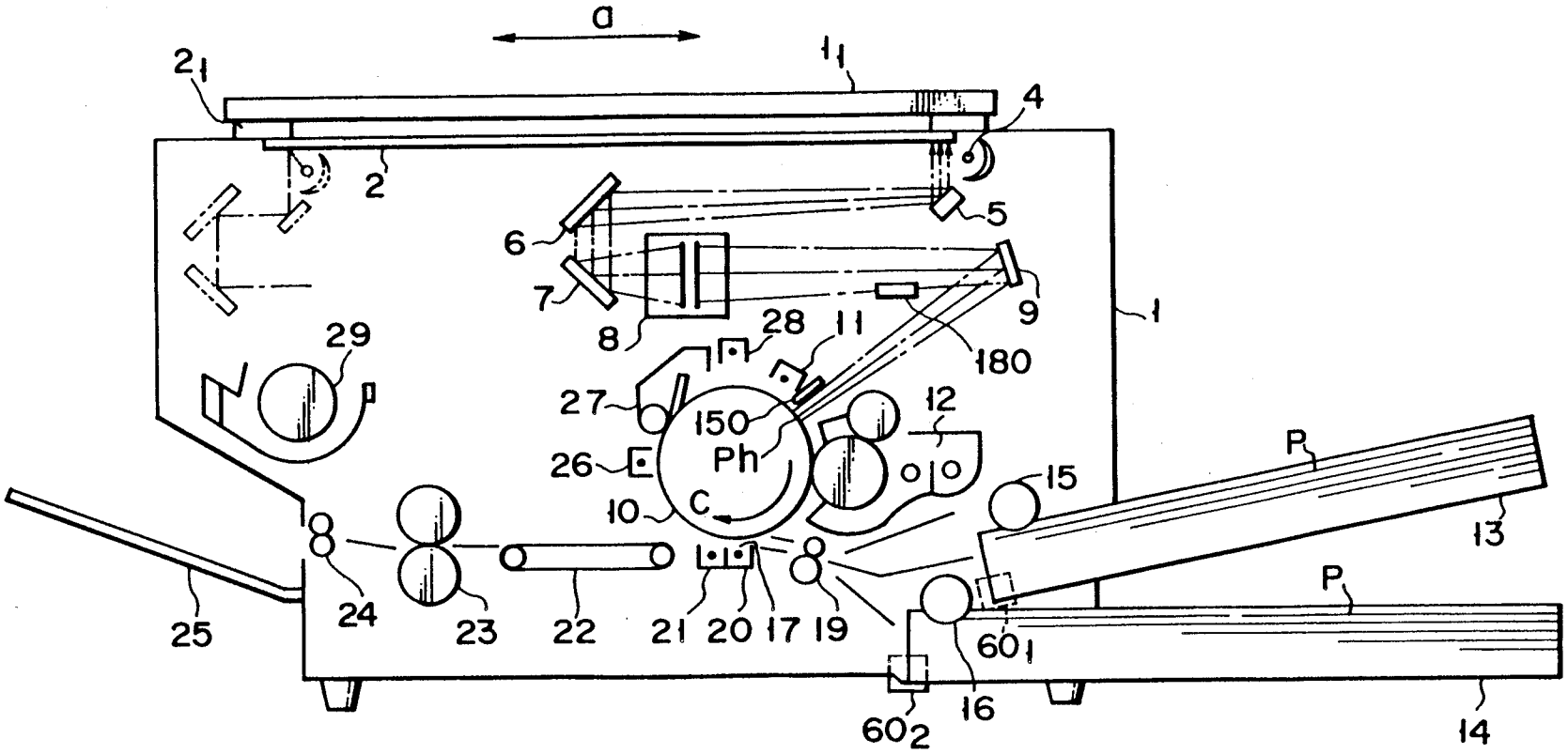
FIG. 26 is a diagram showing the location of a dark region detector of the apparatus shown in FIG. 23.
Figure 27:
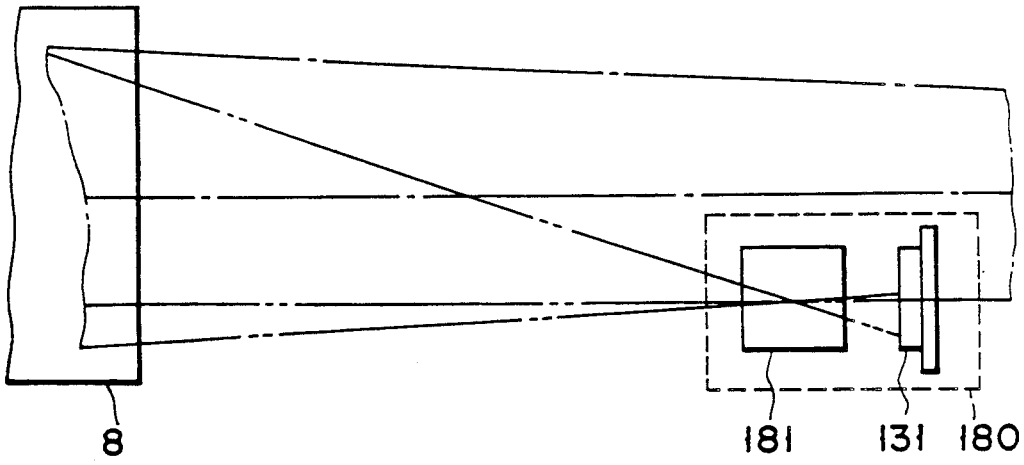
FIG. 27 is a diagram showing the dark region detector shown in FIG. 26.

As shown in FIG. 26, dark region detector 180 for detecting the peripheral edge portion of the original image is disposed between lens block 8 for reduced- or enlarged-size copy and fourth mirror 9. As shown in FIG. 27, detector 180 includes line sensor 131 and lens 181. Sensor 131 outputs image information which corresponds to reflected light from the surface of the original, while lens 181 is used to focus the reflected light from the original surface. In order to complement the optical path length of the reflected light from the original surface, a convex lens is used, as lens 181, for example.

Light emitted from lamp 4 is reflected by the original surface, transmitted through lens block 8, and focused on line sensor 131 by means of lens 181. When the reflected light from the original surface is focused on sensor 131, the image information corresponding thereto is supplied to main processor group 71.

In main processor group 71, the output (image information) of line sensor 131 is converted into a binary code in accordance with a preset threshold value. Based on the result of discrimination between bright (white) and dark (black) picture elements, the peripheral edge portion of the original image is detected, and drive signals, used to drive erase array 150, are produced corresponding to a no-image region outside the peripheral edge portion (or around the region corresponding to the original image). Thus, if the light from lamp 4 is applied to the original when original cover $1_1$ is not fully shut down, those light beams applied to the periphery of the original are not reflected by the cover, so that the region (no-image region) outside the original is detected as a nonreflective region (dark region). Since the periphery of the original image is darkened by the nonreflective region, undesired electric charge remaining on the surface of photosensitive drum 10 cannot be removed, thus developing into an undesired black image on the copy image. Accordingly, black-and-white information in a direction (column-direction) at right angles to the original scanning direction is read to detect the nonreflective region, and the undesired black image is erased by driving erase array 150 in accordance with the detected nonreflective region.

Figure 28:
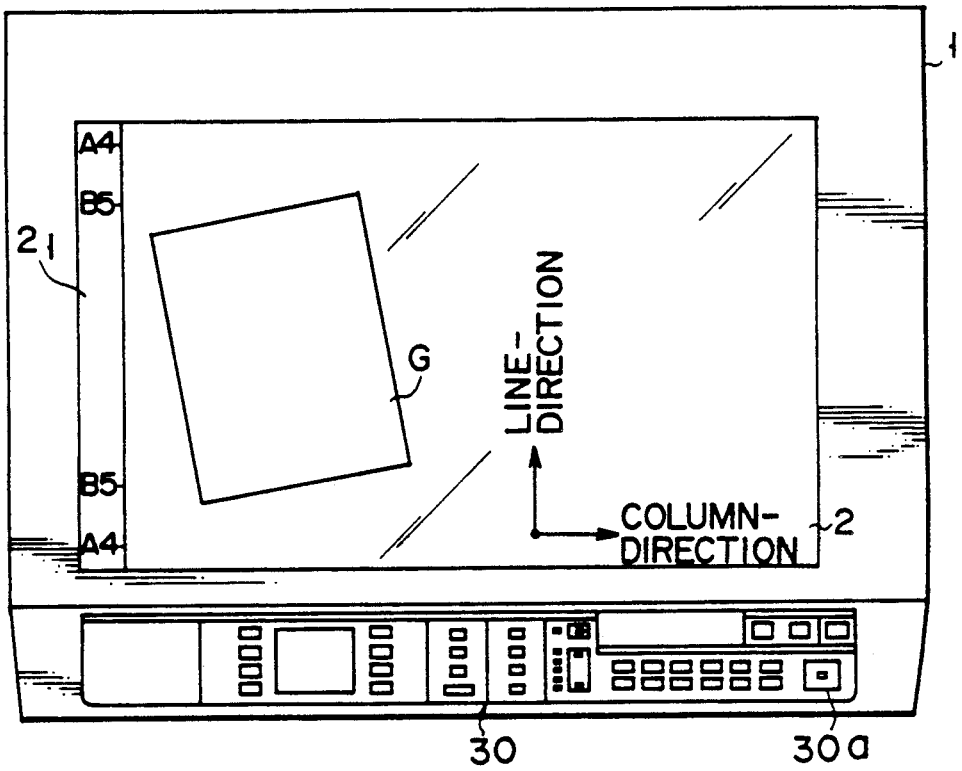
FIG. 28 is a diagram for illustrating a detecting operation using the dark region detector shown in FIG. 27.

As the original is scanned, the drive signals for erase array 150 are successively delivered column by column in the original scanning direction (line-direction), as shown in FIG. 28. In this case, low- and high-level signals are set for white information (white picture elements) and black information (black picture elements), respectively, of the black-and-white information. Also, the low-level signal is set for those black picture elements surrounded by the white picture elements. Thus, the peripheral edge portion (boundary between the white and black picture elements) of the original image on the image information is detected by reading the nonreflective region by means of the black-and-white information, and only the no-image region outside the peripheral edge portion of the original image is set as the erase range (high-level). By doing this, only the undesired black image around the copy image region corresponding to the original image can be erased without erasing necessary black solid images (black regions), if any, in the original image.

As the original is scanned, drive signals for one column are successively supplied from main processor group 71 to array drive unit 160, in the line-direction (see FIG. 28). Drive signals D1 supplied in this manner are transferred to shift register 161 of array drive unit 160 by means of clock signal CLK. When an exposed portion of photosensitive drum 10 reaches erase array 150 after the one-column drive signals are transferred to register 161, latch signal LTH is delivered from main processor group 71. In response to signal LTH, the data stored in shift register 161 are supplied to store register 162. Since array 150 is located between exposure region Ph and developing device 12, the output timing of latch signal LTH is controlled so that the one-column drive signals outputted by main processor group 71 are supplied to register 162 at a point of time corresponding to $\theta_1/\omega$, where $\theta_1$ is the angle between region Ph and erase array 150, and $\omega$ is the angular velocity at which photosensitive drum 10 rotates. Thus, even though an undesired electric charge remains on the no-image region without being de-electrified by the exposure of the original image, it can be removed in real time.

Switch elements 163 of switch circuit 164 are controlled by means of the output signals of store register 162. More specifically, elements 163 are turned on when the output level of register 162 is high, and are turned off when the output level is low. Thus, light emitting elements 152, connected individually to switch elements 163, are lit and put off when elements 163 are turned on and off, respectively. Accordingly, the residual charge on photosensitive drum 10 is removed only for those portions at which elements 152 are lit. Even if the de-electrified portions are developed thereafter, no toner image can be formed thereon, that is, the image is erased. As the original is scanned, the drive signals from main processor group 71 are supplied column by column so that light emitting elements 152 of erase array 150 are lit corresponding to the no-image region outside the peripheral edge portion of the original image. Thus, the undesired black image around the copy image region corresponding to the original image is erased.

The operation of the aforementioned arrangement will now be described. If copy key 30*a* of control panel 30 is operated after original G is set on original table 2, for example, pulse motor driver 80 drives motor 36 in response to a signal from second sub-processor group 73, so that photosensitive drum 10 is actuated. In response to a signal from first sub-processor group 72, moreover, pulse motor driver 79 drives motor 33, thereby moving first carriage $41_1$ from home position HP, corresponding to the copy scale factor, toward second carriage $41_2$ (in direction al) to reach a scanning start position.

Thereafter, lamp regulator 81 lights exposure lamp 4 in response to a signal from main processor group 71. As first carriage $41_1$ is moved away from second carriage $41_2$ (in direction a2) in this light-on state, original G starts to be scanned. More specifically, reflected light beams from original G, irradiated by lamp 4, are reflected by first, second, and third mirrors 5, 6 and 7, and transmitted through lens block 8 for reduced- or enlarged-size copy, and then reflected by fourth mirror 9, to be guided onto photosensitive drum 10. When the original scanning ends, lamp 4 is put off, and first carriage $41_1$ is returned to home position HP.

The light beams transmitted through lens block 8 are detected by means of dark region detector 180, and are focused on line sensor 131 by means of lens 181. The erase range is determined by detecting the peripheral edge portion of the original image in accordance with the output of sensor 131. More specifically, the black picture elements of the image information from sensor 131 are discriminated, e.g., for each line, in the column-direction at right angles to the original scanning direction, by means of the threshold value. Based on the black-and-white information in the column-direction, drive signals are produced such that only the no-image region outside the peripheral edge portion of the original image is to be erased. As original G is scanned, these drive signals are successively supplied to array drive unit 160, column by column in the line-direction.

Figure 29A:
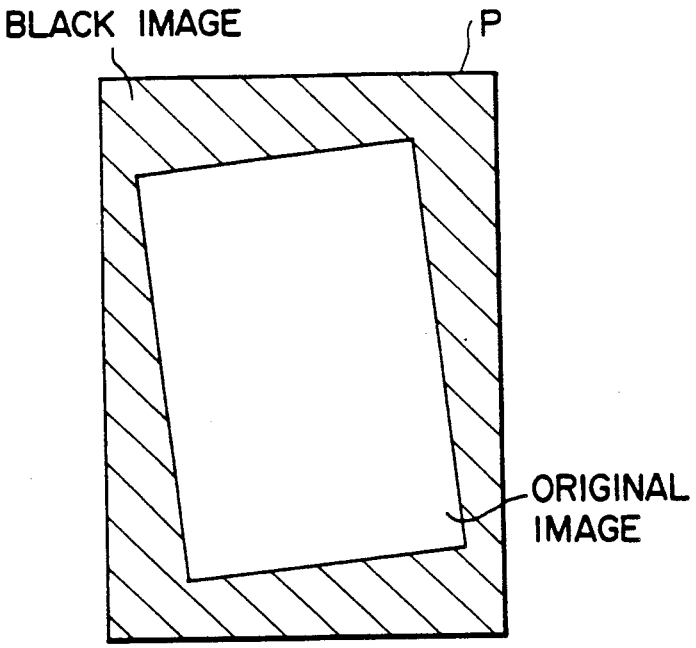
FIG. 29A is a diagram for illustrating a case in which an undesired black image develops on a copy image of a sheetlike original, in the apparatus shown in FIG. 23.
Figure 29B:
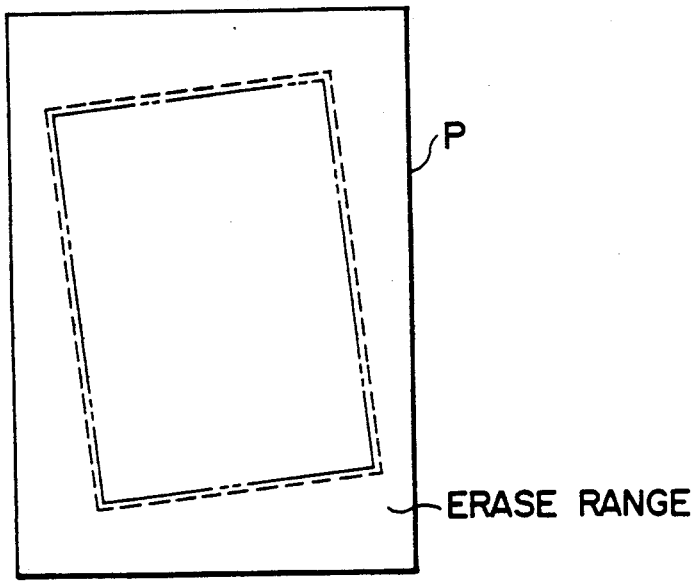
FIG. 29B is a diagram for illustrating a case in which the undesired black image is erased from the copy image of the sheetlike original, in the apparatus shown in FIG. 23.

Thereupon, erase array 150 is driven by means of array drive unit 160, and light emitting elements 152 are lit in accordance with the drive signals from main processor group 71, as mentioned before. As a result, the residual electric charge on that portion of photo-sensitive drum 10 not exposed to the original image in exposure region Ph is removed corresponding to the no-image region outside the peripheral edge portion of the original image at which light emitting elements 152 are lit. Thus, no toner image can be formed on the portion de-electrified by means of erase array 150, within the charged region left on the drum surface by the exposure to the original image, even though the de-electrified portion is developed thereafter. Therefore, even when the image forming operation is performed with original cover $1_1$ not fully shut down, and if the size of original G is smaller than the sheet size designated by means of cassette select key 30*i*, or if the copy size corresponding to the copy scale factor set by means of scale factor setting key 30*h* is smaller than the sheet size although the original and the sheet are equal in size, or if the original is skewed or wrongly set, there is no possibility of an undesired black image (hatched black frame of FIG. 29A) developing around the original image in the copy image on sheet P, as shown in FIG. 29B. Thus, a beautiful copy image can always be obtained. If original G has black solid images (not shown) or the like, only the undesired black image around the copy image region corresponding to the original image can be erased. Accordingly, the copy image can be formed without erasing the necessary black solid images in the copy image region corresponding to the original image. Thus, a beautiful, faithful copy of the original image can be obtained.

Figure 30A:
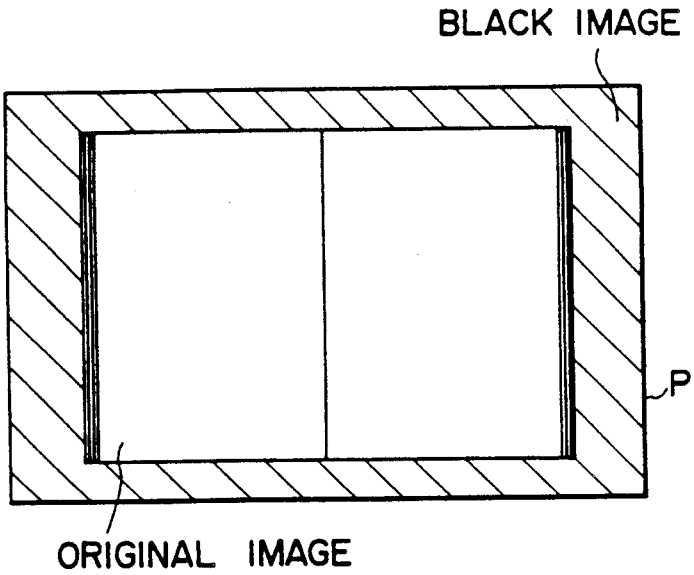
FIG. 30A is a diagram for illustrating a case in which an undesired black image develops on a cop image of a booklike original, in the apparatus shown in FIG. 23.
Figure 30B:
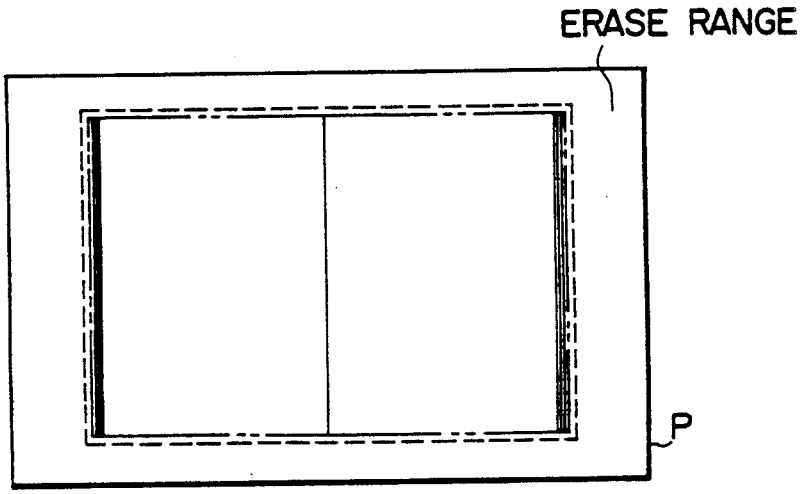
FIG. 30B is a diagram for illustrating a case in which the undesired black image is erased from the copy image of the booklike original, in the apparatus shown in FIG. 23.

Original G used is not limited to a sheet-like form. Even if it is a thick book-like original such that original cover $1_1$ cannot be fully in contact with original table 2, only the undesired black image (hatched black frame shown in FIG. 30A) around the copy image region corresponding to the original image can be erased, as shown in FIG. 30B. Thus, a beautiful, faithful copy of the original image can be obtained. In the embodiment described above, part of the original image (defined by broken line) is also erased (erase range is indicated by two-dot chain line), as shown in FIGS. 29B and 30B, due to diffusion of the emitted light beams from light emitting elements 152 and other causes. Thus, the undesired black image around the original image can be thoroughly erased from the copy image.

During the original scanning, as described above, the peripheral edge portion of the original image is detected by means of the reflected light beams from the original surface. The undesired black image developed around the copy image portion, corresponding to the original image, can be erased by removing the undesired electric charge on that portion of photosensitive drum 10 which corresponds to the no-image region outside the peripheral edge portion of the original image.

Thus, the drive signals for driving erase array 150 are produced by means of the reflected light beams from the original to be subjected to the image forming operation. Accordingly, the image in the no-image region can be erased at real time without requiring preliminary scanning for the detection of the dark region (nonreflective region) to be subjected to the erase operation. Therefore, even if the original size or the copy size is smaller than the sheet size, or if the original is wrongly set, for example, when original cover $1_1$ is not shut down, or is prevented from being fully shut down by the thickness of the original, only the undesired black image around the copy image region corresponding to the original image can be erased. Thus, a beautiful, high-quality, faithful copy of the original image can be obtained. The developing agent, which is not applied to the region of the copy image outside the region corresponding to the original image, can be prevented from being wastefully consumed. Since the dark region detection is performed simultaneously with the image forming operation, moreover, the efficiency of the erase operation is improved.

Since the beautiful copy image, free of the undesired black image, can be obtained even with original cover 11 off, furthermore, the cover need not be shut down with every copying cycle.

The present invention is not limited to the embodiment described above. When original cover 11 is fully shut down, for example, the undesired black image never develops, so that the aforesaid erase operation is unnecessary. When it is detected that the state of cover $1_1$ is fully shut down, therefore, the erase operation may be omitted. In this case, for example, dark region detector 180 may be made movable so that it can be shunted from the optical path when the entire placement of cover $1_1$ is detected.

Moreover, control panel 30 may be provided with an operation key for mode designation, which is used to designate a "frame erase" mode, whereby the erase operation can be performed in accordance with mode designation.

Figure 31:
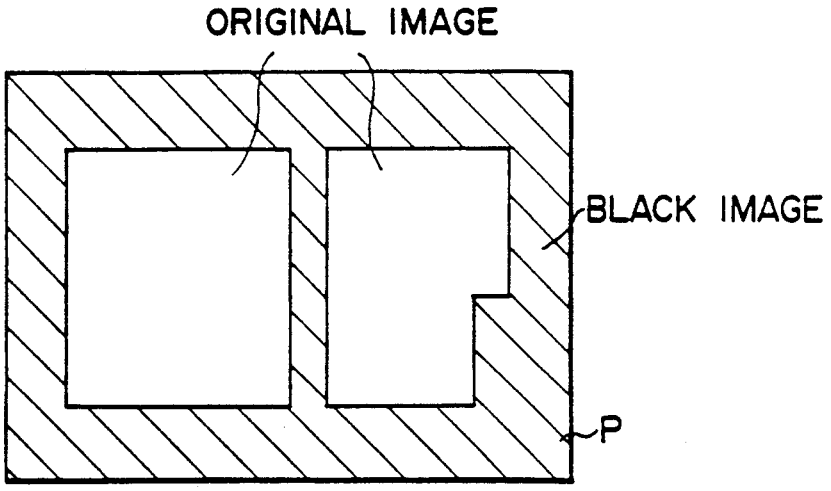
FIG. 31 is a diagram showing a case in which a copy image erasable in the apparatus shown in FIG. 23 and corresponding to a plurality of original images is formed on one copying sheet.
Figure 32:
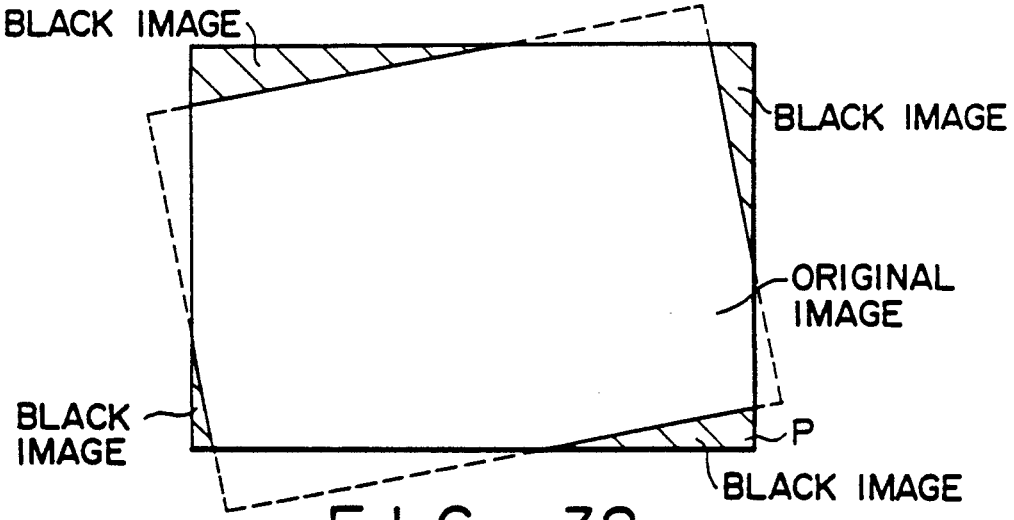
FIG. 32 is a diagram showing a case in which a copy image erasable in the apparatus shown in FIG. 23 and including a plurality of undesired black images is formed on one copying sheet.
Figure 33:
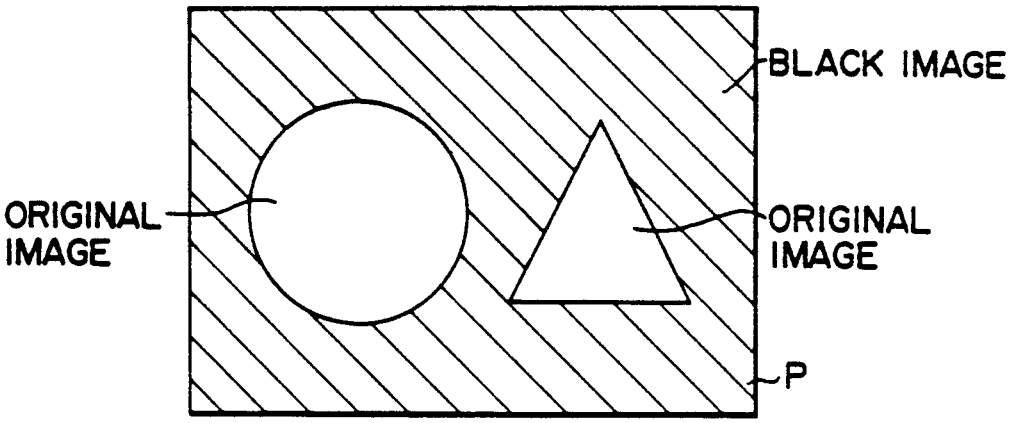
FIG. 33 is a diagram showing a case in which a copy image erasable in the apparatus shown in FIG. 23 and corresponding to original images of irregular shapes is formed on one copying sheet.

In the aforementioned embodiment, a copy of one original image is formed on each copying sheet P. As shown in FIG. 31, however, an undesired black image (hatched portion) developed around copy image regions corresponding to a plurality of original images may be also erased. As shown in FIG. 32, moreover, a plurality of undesired black images (hatched portions) may be erased in like manner. Furthermore, the shape of original G is not limited to a regular one, and an undesired black image (hatched portion) developed around copy image regions which correspond to, e.g., circular and/or triangular original images, as shown in FIG. 33.

Figure 34:
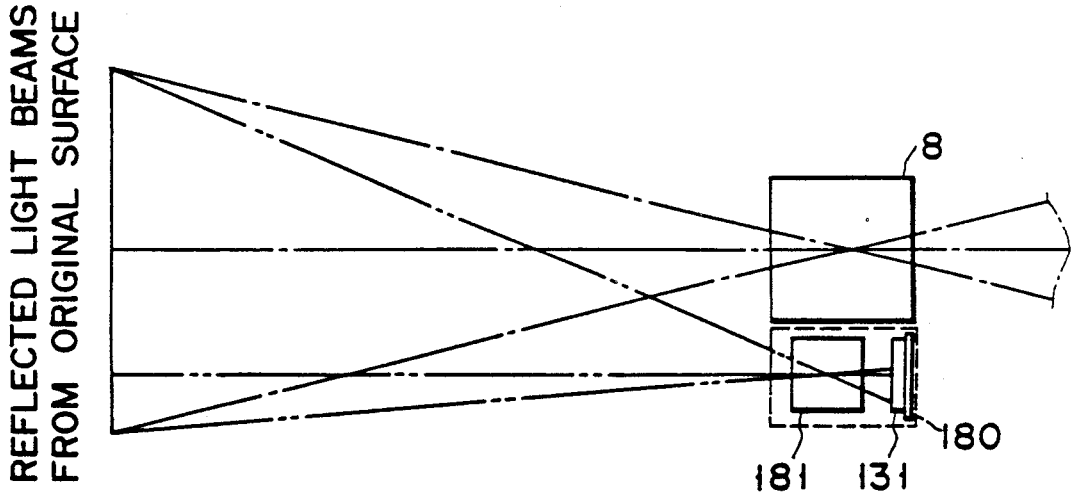
FIG. 34 is a diagram showing a modification of the dark region detector shown in FIG. 27.

In the aforementioned embodiment, moreover, dark region detector 180 is located in the optical path so that the reflected light beams transmitted through lens block 8 for reduced- or enlarged-size copy are focused on line sensor 131. As shown in FIG. 34, however, detector 180 may be located off the optical path so that the light beams are focused on sensor 131 without being transmitted through lens block 8. In this case, the areas of projection of lens 181 and sensor 131 can be prevented from influencing the image forming operation, e.g., from darkening the whole image.

What is claimed is:

1. An image forming apparatus comprising:

means for carrying an original thereon;

cover means movable between a first position in which cover means covers the original and the carrying means and a second position in which the cover means leaves exposed the original and the surrounding portion of the carrying means;

image forming means for forming on an image carrier a first copy image corresponding to an image of the original on the carrying means and a second copy image corresponding to an image surrounding the original; and means for preventing the formation of the second copy image when the cover means is positioned in the second position.

2. The image forming apparatus according to claim 1, which further includes means for detecting the position of the cover means and controlling the preventing means according to the position of the cover means.

3. The image forming apparatus according to claim 2, which includes means for providing a support medium on the image carrier, and means for transferring the copy image from the image carrier to the support medium; and in which said preventing means includes means for comparing the size of the support medium to that of the first copy image formed on the image carrier, and a preventing device for preventing the second copy image from being formed on the image carrier when the size of the first copy image is smaller than that of the support image.

4. The image forming apparatus according to claim 1, wherein said image forming means includes a charging means for charging the image carrier, an optical means for forming an information light which carries original image information and surrounding image information, and applying the information image to the previously charged image carrier, thereby forming an electrostatic latent image thereon.

5. The image forming apparatus according to claim 4, wherein said optical means includes scanning means for optically scanning the original and the surrounding region, and guiding a reflected light from the original and the surrounding region onto the image carrier, thereby focusing the light thereon.

6. The image forming apparatus according to claim 1, wherein said size detecting means detects regular original sizes.

7. The image forming apparatus according to claim 6, wherein said size detecting means discriminates the regular original sizes by detecting an end portion of the original.

8. The image forming apparatus according to claim 7, wherein said size detecting means includes light emitting means for emitting light toward the original and the surrounding region and light receiving means for receiving light from the original and the surrounding region.

9. The image forming apparatus according to claim 5, wherein said size detecting means includes light emitting means for emitting light toward the original and the surrounding region, light receiving means for receiving light from the original and the surrounding region, and means for simultaneously moving the light emitting and receiving means and the scanning means.

10. The image forming apparatus according to claim 9, wherein said detecting means includes a plurality of sets of said light emitting and receiving means.

11. The image forming apparatus according to claim 1, wherein said image forming means includes latent image forming means for forming first and second latent images as the first and second copy images on the image carrier.

12. The image forming apparatus according to claim 7, further comprising visualizing means for visualizing the first and second latent image and transfer means for transferring the visualized images to the surface of a support medium.

13. The image forming apparatus according to claim 10, wherein said preventing means includes comparator means for comparing the size of the support medium to that of the image formed on the basis of the original detected by the detecting means, and a preventing device for preventing the second copy image from being formed on the image carrier when it is concluded that the image size is smaller than the support medium size.

14. The image forming apparatus according to claim 11, wherein said preventing device includes erase means for selectively erasing an electric charge within a predetermined range on the image carrier, and erase range setting means for setting a range to be erased by the erase means.

15. The image forming apparatus according to claim 12, wherein said erase means includes means for erasing the electric charge on the image carrier before the second latent image is formed by the latent image forming means.

16. The image forming apparatus according to claim 12, wherein said erase means includes means for erasing the second latent image.

17. The image forming apparatus according to claim 11, wherein said preventing device prevents the formation of the peripheral edge portion of the first copy image, as well as the formation of the second copy image.

18. The image forming apparatus according to claim 10, further comprising carrying means for carrying the original to be scanned by the scanning means, cover means for covering the original on the carrying means, and cover detecting means for detecting the presence of the cover means on the original.

19. The image forming apparatus according to claim 16, wherein said preventing means includes comparator means for comparing the size of the support medium to that of the image formed on the basis of the size of the original detected by the detecting means, and a preventing device for preventing the second copy image from being formed on the image carrier when it is concluded that the image size is smaller than the support medium size and if the presence of the cover means on the original is detected by the cover detecting means.

20. An image forming apparatus comprising:

an image carrier;

charging means for charging the image carrier;

illumination means for illuminating an original;

optical means for guiding light reflected from the original onto the charged image carrier, thereby forming an electrostatic latent image thereon;

detecting means for detecting an image region corresponding to an image of the original by detecting the light guided by the optical means; and erase means for erasing an electric charge on the image carrier corresponding to a no-image region outside the image region.

21. The image forming apparatus according to claim 20, wherein said optical means includes focusing means for focusing the light from the original on the image carrier.

22. The image forming apparatus according to claim 20, wherein said detecting means detects those beams of the light from the original which are transmitted through the focusing means.

23. The image forming apparatus according to claim 20, wherein said detecting means detects those beams of the light from the original which are not transmitted through the focusing means.

24. The image forming apparatus according to claim 20, wherein said detecting means includes a detector adapted to receive the light from the original and deliver image information corresponding to the received light, and focusing means for focusing the light from the original on the detector.

25. An image forming apparatus comprising:

image forming means for forming on an image carrier a first copy image corresponding to an image of the original on the carrying means and a second copy image corresponding to an image of a region surrounding the original;

means for detecting the size of the original;

means for preventing the formation of the second copy image in accordance with the result of detection by the size detecting means; and means for moving the image forming means and size detecting means simultaneously against the original in the same direction two times in every copying cycle so that the size detecting means detects the size of the original while moving for the first time, and the image forming means forms the copy image on the carrier while moving for the second time.

26. An image forming apparatus comprising:

an image carrier movable in one direction;

image forming means for scanning the original in one direction to form a first copy image corresponding to an image of the original and a second copy image corresponding to an image of a region surrounding the original onto the image carrier during the movement of the image carrier;

means for detecting the size of the original; and means for preventing the formation of the second copy image in accordance with the result of detection by the size detecting means, while the image forming means scans the original and the image carrier is moved in said direction.

27. The image forming apparatus according to claim 26, wherein said preventing means includes erase means having a plurality of erase elements linearly arranged at right angles to the moving direction of the image carrier, and means for selectively driving the erase elements during the movement of the image carrier so that the formation of the second copy image is prevented.

* * * * *